US006903686B2

(12) United States Patent
Vance et al.

(10) Patent No.: US 6,903,686 B2
(45) Date of Patent: Jun. 7, 2005

(54) MULTI-BRANCH PLANAR ANTENNAS HAVING MULTIPLE RESONANT FREQUENCY BANDS AND WIRELESS TERMINALS INCORPORATING THE SAME

(75) Inventors: Scott LaDell Vance, Cary, NC (US); Gerard Hayes, Wake Forest, NC (US); Huan-Sheng Hwang, Cary, NC (US); Robert A. Sadler, Raleigh, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 71 days.

(21) Appl. No.: 10/443,202

(22) Filed: May 22, 2003

(65) Prior Publication Data

US 2004/0116157 A1 Jun. 17, 2004

Related U.S. Application Data

(63) Continuation-in-part of application No. 10/248,082, filed on Dec. 17, 2002.

(51) Int. Cl.[7] ..... H01Q 1/38; H01Q 1/24

(52) U.S. Cl. ..... 343/700 MS; 343/702

(58) Field of Search ..... 343/700 MS, 702, 343/846, 848, 895, 873; H01Q 1/38, 1/24

(56) References Cited

U.S. PATENT DOCUMENTS

| | | | | |
|---|---|---|---|---|
| 5,434,579 | A | 7/1995 | Kagoshima et al. | 343/700 MS |
| 5,684,492 | A | 11/1997 | Kagoshima et al. | 343/700 MS |
| 5,926,139 | A | 7/1999 | Korisch | 343/702 |
| 6,166,694 | A | 12/2000 | Ying | 343/702 |
| 6,229,487 | B1 | 5/2001 | Sadler et al. | 343/700 MS |
| 2001/0054979 | A1 * | 12/2001 | Bahr et al. | 343/700 MS |
| 2002/0003499 | A1 | 1/2002 | Kouam et al. | 343/700 |
| 2003/0032443 | A1 * | 2/2003 | Johnson et al. | 455/550 |
| 2003/0117324 | A1 * | 6/2003 | Iwai et al. | 343/702 |
| 2004/0056804 | A1 * | 3/2004 | Kadambi et al. | 343/700 MS |
| 2004/0080457 | A1 * | 4/2004 | Guo et al. | 343/700 MS |

FOREIGN PATENT DOCUMENTS

| | | | |
|---|---|---|---|
| DE | 201 14 387 U1 | 8/2001 | H01Q/1/38 |
| EP | 1 052 723 A2 | 5/2000 | H01Q/9/04 |
| EP | 1 154 518 A2 | 5/2001 | H01Q/9/04 |
| WO | WO 00/36700 | 6/2000 | H01Q/1/24 |

OTHER PUBLICATIONS

Dou, Wei Ping et al., Novel Meandered Planar Inverted–F Antenna For Triple–Frequency Operation, Microwave and Optical Technology Letters, Oct. 5, 2000, pp. 58–60, vol. 27, No. 1, Singapore.

Ollikainen, Jani et al., Internal Dual–Band Patch Antenna for Mobile Phones,Helsinki University of Technology, Finland, date unknown, but for examination purposes, the date is before Dec. 17, 2002, p. 364 (4 sheets).

Wong, Kin–Lu, Chapter One, Introduction and Overview, Planar Antennas for Wireless Communications, Jan. 2003, pp. 1–25, ISBN: 0–471–26611–6.

Chiu et al., *Compact dual–band PIFA with multi–resonators*, Electronics Letters, vol. 38, No. 12, 2 sheets, Jun. 6, 2002.

Patent Abstracts of Japan, vol. 1998, No. 09, Publication No. 10093331, *Microstrip Antenna System*, 1 sheet, Publication Date Oct. 4, 1998.

PCT International Search Report, International Application No. PCT/US03/18296 mailed Oct. 20, 2003.

* cited by examiner

*Primary Examiner*—Hoanganh Le
(74) *Attorney, Agent, or Firm*—Myers Bigel Sibley & Sajovec PA

(57) ABSTRACT

A conductive element with a primary branch and a secondary branch are separated by a bend segment and the signal and ground feeds are positioned adjacent each other on a common portion of the conductive element. The frequencies in the high band may be at least about twice that of the frequencies in the low band. The branches and bend segment are constructed such that the primary branch radiates at both high and low band operation. The two branches combine to form a more efficient high band radiator.

64 Claims, 15 Drawing Sheets

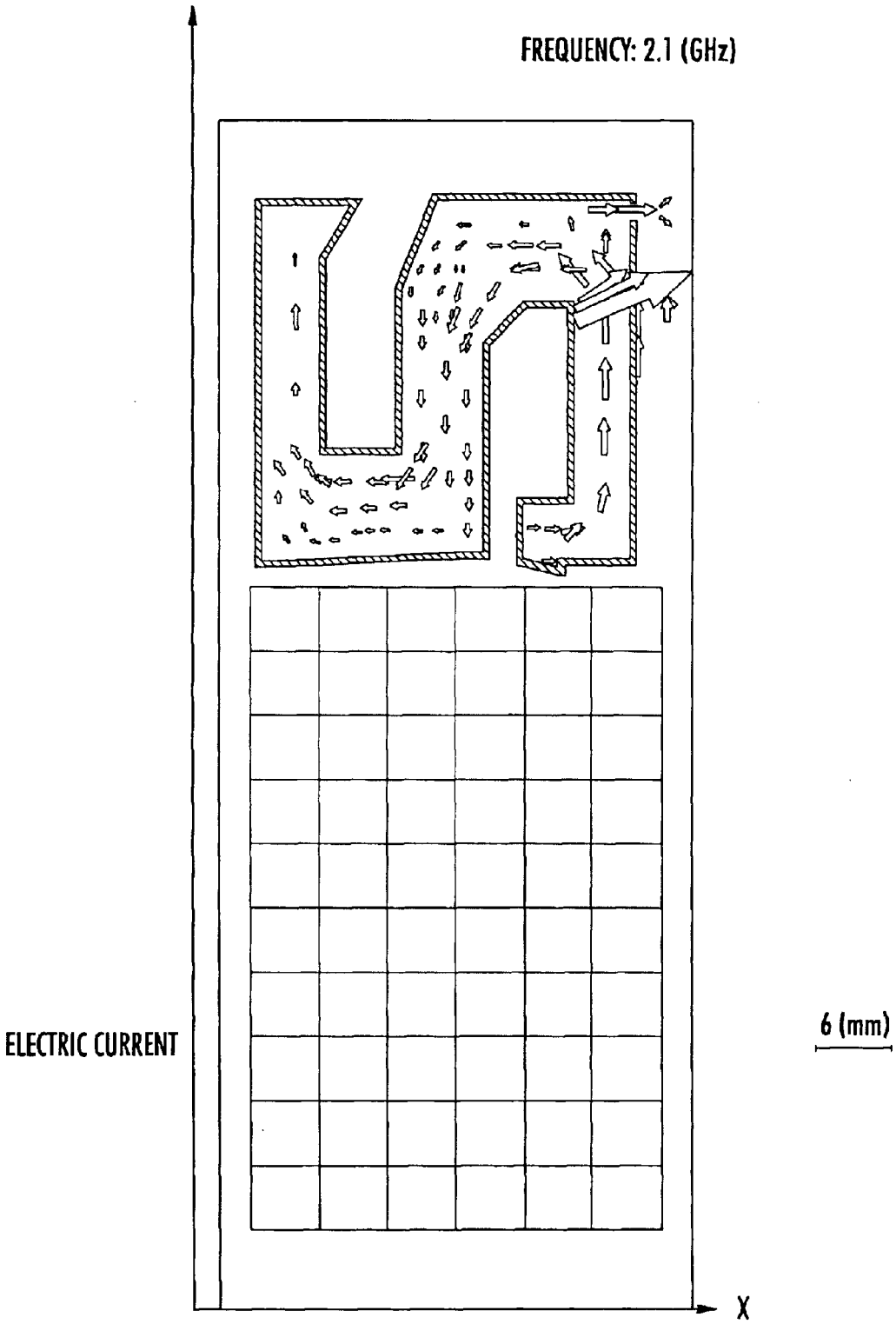
FIG. 8B CURRENT VECTOR PLOT 2.1 Ghz in-ϕ

MULTI-BRANCH PLANAR ANTENNAS HAVING MULTIPLE RESONANT FREQUENCY BANDS AND WIRELESS TERMINALS INCORPORATING THE SAME

RELATED APPLICATIONS

This application is a continuation-in-part of U.S. patent application Ser. No. 10/248,082, filed Dec. 17, 2002, entitled Multi-band, Inverted-F Antenna with Capacitively Created Resonance, and Radio Terminal Using Same, the contents of which are hereby incorporated by reference as if recited in full herein.

FIELD OF THE INVENTION

The present invention relates to the field of communications, and, more particularly, to antennas and wireless terminals incorporating the same.

BACKGROUND OF THE INVENTION

The size of wireless terminals has been decreasing with many contemporary wireless terminals being less than 11 centimeters in length. Correspondingly, there is increasing interest in small antennas that can be utilized as internally mounted antennas for wireless terminals. Inverted-F antennas, for example, may be well suited for use within the confines of wireless terminals, particularly wireless terminals undergoing miniaturization. Typically, conventional inverted-F antennas include a conductive element that is maintained in a spaced apart relationship with a ground plane. Exemplary inverted-F antennas are described in U.S. Pat. Nos. 5,684,492 and 5,434,579, which are incorporated herein by reference in their entirety.

Furthermore, it may be desirable for a wireless terminal to operate within multiple frequency bands in order to utilize more than one communications system. For example, Global System for Mobile communication (GSM) is a digital mobile telephone system that typically operates at a low frequency band, such as between 880 MHz and 960 MHz. Digital Communications System (DCS) is a digital mobile telephone system that typically operates at high frequency bands, such as between 1710 MHz and 1880 MHz. In addition, global positioning systems (GPS) or Bluetooth systems use frequencies of 1.575 or 2.4–2.48 GHz. The frequency bands allocated for mobile terminals in North America include 824–894 MHz for Advanced Mobile Phone Service (AMPS) and 1850–1990 MHz for Personal Communication Services (PCS). Other frequency bands are used in other jurisdictions. Accordingly, internal antennas are being provided for operation within multiple frequency bands.

FIG. 1 illustrates one example of a prior art PIFA (planar inverted "F" antenna) that uses a center signal fed planar antenna shape with capacitive coupling 10. Generally stated, the high band element has an end portion that typically capacitively couples to a closely spaced apart end portion of the low band element, which, in operation, may cause a larger portion of the antenna element to radiate. U.S. Pat. No. 6,229,487 describes similar configurations for wireless devices, the contents of which are hereby incorporated by reference as if recited in full herein. Unfortunately, the increase in the coupling between the two elements by this configuration may result in degradation in bandwidth at the low-band element. In addition, the parasitic element may dictate tight manufacturing tolerances for proper operation that may increase production costs.

Kin-Lu Wong, in *Planar Antennas for Wireless Communications*, Ch. 1, p. 4, (Wiley, Jan. 2003), illustrates some potential radiating top patches for dual-frequency PIFAS. As shown, the PIFA in FIG. 1.2(*g*) has a plurality of bends, but the configuration is such that the capacitive coupling between the two branches (primary and secondary branches) is most likely very large.

Despite the foregoing, there remains a need for alternative multi-band planar antennas.

SUMMARY OF THE INVENTION

Embodiments of the present invention provide antennas for communications devices and wireless terminals. The conductive planar element may be particularly suitable for a planar inverted-F antenna (PIFA) element.

Planar inverted-F antennas are configured to operate at a plurality of resonant frequency bandwidths of operation and include: (a) a signal feed; (b) a ground feed; and (c) a conductive element in communication with the signal and ground feed. The conductive element includes a primary branch in communication with the signal and ground feeds. The primary (for example, low band) branch has opposing first and second end portions and a first current path length. The conductive element also includes a secondary branch in communication with the signal and ground feeds. The secondary (for example, high band) branch has opposing first and second end portions and a second current path length. The length of the second current path is shorter than that of the first current path. The conductive element also includes a bend segment having opposing end portions positioned intermediate the primary and secondary branches configured to join the primary and secondary branches. The antenna is configured to operate at first and second different resonant frequency bands, with the primary branch configured to radiate at the first band independent of proximity coupling to the secondary branch.

The bend segment and/or secondary branch is configured and positioned with respect to the signal and ground, so that in primary band operation, current flows primarily into the primary branch and bend segment and so that, in secondary band operation, current flows in at least a major portion of both the primary and secondary branches.

In certain embodiments, the ground and signal feeds can be positioned adjacent each other on a common portion (which may be proximate to and/or at a common outer edge portion) of the conductive element. The frequencies in the high band may be at least about twice that of the frequencies in the low band. In particular embodiments, the secondary branch is conductively coupled to the signal and ground feeds and the primary branch is also conductively coupled to the signal and ground feeds via the bend segment. The bend segment can provide a current path that is substantially orthogonal to the current path in the secondary branch.

The antenna conductive element is configured so that parasitic and/or capacitive coupling between the primary and secondary branches is not required to have the primary branch radiate at low band.

Other embodiments are directed to a planar inverted-F antenna having a planar conductive element and signal and ground feeds positioned on a common outer edge portion thereof. The conductive element includes: (a) first, second and third elongated branch segments, each having opposing first and second end portions, wherein the first, second and third elongated branch segments are spaced apart from each other with the second elongated segment being intermediate of the first and third elongated segments; (b) a first bend segment extending between the first and second elongated segments at a corresponding one of the first or second end portions thereof; and (c) a second bend segment extending between the second and third elongated segments at the other corresponding end portion. The antenna is configured to operate at least first and second different resonant frequency bands. The conductive element includes a primary current path that radiates during first band operation comprises two of the first, second and third elongated segments and at least one of the bend segments. The conductive element also includes a secondary current path that radiates primarily during high band operation that comprises the remaining one of the first, second or third elongated segment. The antenna is configured to operate at first and second different resonant frequency bands with the primary current path being configured to radiate at the first band independent of proximity coupling to the secondary current path.

In certain embodiments, the second resonant frequency band operates at frequencies that are greater than or equal to at least twice the value of the frequencies of the first resonant frequency band.

Other embodiments are directed to a wireless terminal, including: (a) a housing configured to enclose a transceiver that transmits and receives wireless communications signals; (b) a ground plane disposed within the housing; (c) a planar inverted-F antenna disposed within the housing and electrically connected with the transceiver; (d) a signal feed electrically connected to the secondary branch or bend segment of the primary branch of the conductive element; and (e) a ground feed electrically connected to the conductive element proximate the signal feed. The antenna includes a planar dielectric substrate and a planar conductive element disposed on the planar dielectric substrate. The antenna conductive element includes: (a) a primary branch having a bend segment, the primary branch configured to define about a ¼ wave resonator at a low frequency band and about a ½ wave resonator at a high frequency band; and (b) a secondary branch sized and configured to provide about a ¼ wave resonator at the high frequency band. The conductive element is configured to allow the resonances of the secondary and primary branches to combine at the high frequency band. The signal and ground feeds may be positioned proximate to each other on a common portion of the conductive element. In particular embodiments, the signal and ground feeds may be positioned on an outer edge portion of the element.

Other embodiments of the present invention are directed toward methods for exciting a planar inverted F antenna having low and high band operational modes. The methods include: (a) providing a conductive element with primary and secondary resonant branches, the conductive element configured so that the secondary branch terminates into a bend region before extending into the primary branch, the primary branch being configured to form about a ¼ wave resonator at a low frequency band and a ½ wave resonator at a high frequency band, the secondary branch configured to act as about a ¼ wave resonant at the high frequency band and to substantially be devoid of irradiation at the low frequency band; (b) generating a high impedance node at the high frequency band to provide a current null proximate the bend region of the primary branch; and (c) causing the primary branch with the secondary branch resonance to provide about a ½ wave resonator at the high frequency band.

In further embodiments of the present invention, the first resonant frequency band may include at least one of 800 MHz, 900 MHz, 1800 MHz and/or 1900 MHz. The second resonant frequency band may include at least one different one of 800 MHz, 900 MHz, 1800 MHz and/or 1900 MHz.

BRIEF DESCRIPTION OF THE DRAWINGS

FIG. 8B is a current vector plot of the antenna shown in FIG. 8A at 2.1 GHz.

DETAILED DESCRIPTION OF EMBODIMENTS OF THE INVENTION

Figure 1:
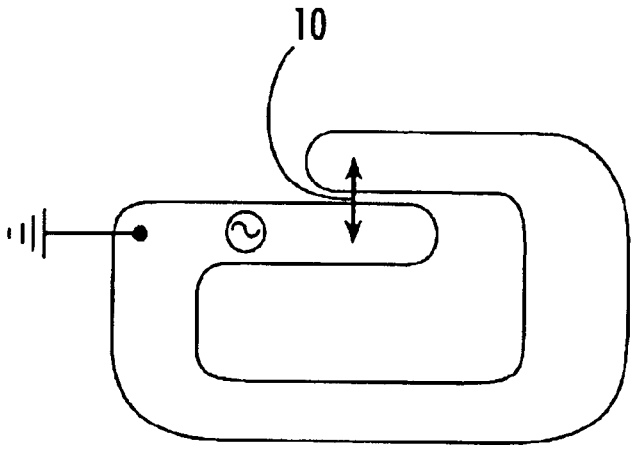
FIG. 1 (PRIOR ART)
FIG. 1 is a top view of a prior art planar inverted-F antenna configuration.

The present invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, element number 20 generally refers to an antenna and this element number 20 is also used with uppercase alpha suffixes to denote certain embodiments thereof (i.e., 20A, 20B, 20C) for clarity of discussion. Feature 20*b* (lower case "b") refers to the bend segment and not a general antenna element embodiment. It will be appreciated that although discussed with respect to a certain antenna embodiment, features or operation of one antenna embodiment can apply to others.

In the drawings, the thickness of lines, layers, features, components and/or regions may be exaggerated for clarity. It will be understood that when a feature, such as a layer, region or substrate, is referred to as being "on" another feature or element, it can be directly on the other element or intervening elements may also be present. In contrast, when an element is referred to as being "directly on" another feature or element, there are no intervening elements present. It will also be understood that, when a feature or element is referred to as being "connected" or "coupled" to another feature or element, it can be directly connected to the other element or intervening elements may be present. In contrast, when a feature or element is referred to as being "directly connected" or "directly coupled" to another element, there are no intervening elements present.

Embodiments of the present invention will now be described in detail below with reference to FIGS. 2 through 9. The inverted-F conductive element can be configured to operate at first and second resonant frequency bands and, in certain particular embodiments, can also be configured to operate at a third or more resonant frequency bands. Antennas according to embodiments of the present invention may be useful in, for example, multiple mode wireless terminals that support two or more different resonant frequency bands, such as world phones and/or dual mode phones. In certain embodiments, the antennas of the present invention can operate in a low frequency band and a high frequency band. The terms "low frequency band" or "low band" are used interchangeably and, in certain embodiments, include frequencies below about 1 GHz, and typically comprises at least one of 824–894 MHz or 880–960 MHz. The terms "high frequency band" and "high band" are used interchangeably and, in certain embodiments, include frequencies above 1 GHz, and typically frequencies between about 1.5–2.5 GHz. Frequencies in high band can include selected ones or ranges within about 1700–1990 MHz, 1990–2100 MHz, and/or 2.4–2.485 GHz.

In certain embodiments, the high frequency band may include frequencies that are at least about twice that of the frequencies of the low frequency band. For example for a low band mode operating with frequencies between about 824–894 MHz, the high band mode can operate at frequencies equal to or above 1.648–1.788 GHz.

As used herein, the term "wireless terminal" may include, but is not limited to, a cellular wireless terminal with or without a multi-line display; a Personal Communications System (PCS) terminal that may combine a cellular wireless terminal with data processing, facsimile and data communications capabilities; a PDA that can include a wireless terminal, pager, internet/intranet access, web browser, organizer, calendar and/or a global positioning system (GPS) receiver; and a conventional laptop and/or palmtop receiver or other appliance that includes a wireless terminal transceiver. Wireless terminals may also be referred to as "pervasive computing" devices and may be mobile terminals.

It will be understood by those having skill in the art of communications devices that an antenna is a device that may be used for transmitting and/or receiving electrical signals. During transmission, an antenna may accept energy from a transmission line and radiate this energy into space. During reception, an antenna may gather energy from an incident wave and provide this energy to a transmission line. The amount of power radiated from or received by an antenna is typically described in terms of gain.

Voltage Standing Wave Ratio (VSWR) relates to the impedance match of an antenna feed point with a feed line or transmission line of a communications device, such as a wireless terminal. To radiate radio frequency energy with minimum loss, or to pass along received RF energy to a wireless terminal receiver with minimum loss, the impedance of a wireless terminal antenna is conventionally matched to the impedance of a transmission line or feed point. Conventional wireless terminals typically employ an antenna that is electrically connected to a transceiver operatively associated with a signal processing circuit positioned on an internally disposed printed circuit board. In order to increase the power transfer between an antenna and a transceiver, the transceiver and the antenna may be interconnected such that their respective impedances are substantially "matched," i.e., electrically tuned to compensate for undesired antenna impedance components, to provide a 50-Ohm (Ω) (or desired) impedance value at the feed point.

An inverted-F antenna 20 according to the invention can be assembled into a device with a wireless terminal 200 (as shown for example in FIG. 7) such as a radiotelephone terminal with an internal ground plane 161*g* and transceiver components 161*s* operable to transmit and receive radiotelephone communication signals. The antenna 20 is disposed substantially parallel to the ground plane 161*g* and is connected to the ground plane 161*g* and the transceiver components 161*s* via respective ground and signal feeds, 61*g*, 61*s*, respectively. The antenna 20 may be formed or shaped with a certain size and a position with respect to the ground plane so as to conform to the shape of the radiotelephone terminal housing or a subassembly therein. For example, the antenna may be placed on a substrate that defines a portion of an enclosed acoustic chamber. Thus, the antenna may not be strictly "planar" although in the vernacular of the art, it might still be referred to as a planar inverted-F antenna.

In addition, it will be understood that although the term "ground plane" is used throughout the application, the term "ground plane", as used herein, is not limited to the form of a plane. For example, the "ground plane" may be a strip or any shape or reasonable size and may include non-planar structures such as shield cans or other metallic objects.

The antenna conductive element may be provided with or without an underlying substrate dielectric backing, such as, for example, FR4 or polyimide. In addition, the antenna may include air gaps in the spaces between the branches or segments. Alternatively, the spaces may be at least partially filled with a dielectric substrate material or the conductive pattern formed over a backing sheet. Furthermore, an inverted-F conductive element, according to embodiments of the present invention, may have any number of branches disposed on and/or within a dielectric substrate.

The antenna conductive element may be formed of copper and/or other suitable conductive material. For example, the conductive element branches may be formed from copper sheet. Alternatively, the conductive element branches may be formed from copper layered on a dielectric substrate. However, conductive element branches for inverted-F conductive elements according to the present invention may be formed from various conductive materials and are not limited to copper as is well known to those of skill in the art. The antenna can be fashioned in any suitable manner, including, but not limited to, metal stamping, forming the conductive material in a desired pattern on a flex film or other substrate whether by depositing, inking, painting, etching or otherwise providing conductive material traces onto the substrate material.

It will be understood that, although antennas according to embodiments of the present invention are described herein with respect to wireless terminals, embodiments of the present invention are not limited to such a configuration. For example, antennas according to embodiments of the present invention may be used within wireless terminals that may only transmit or only receive wireless communications signals. For example, conventional AM/FM radios or any receiver utilizing an antenna may only receive communications signals. Alternatively, remote data input devices may only transmit communications signals.

Figure 2:
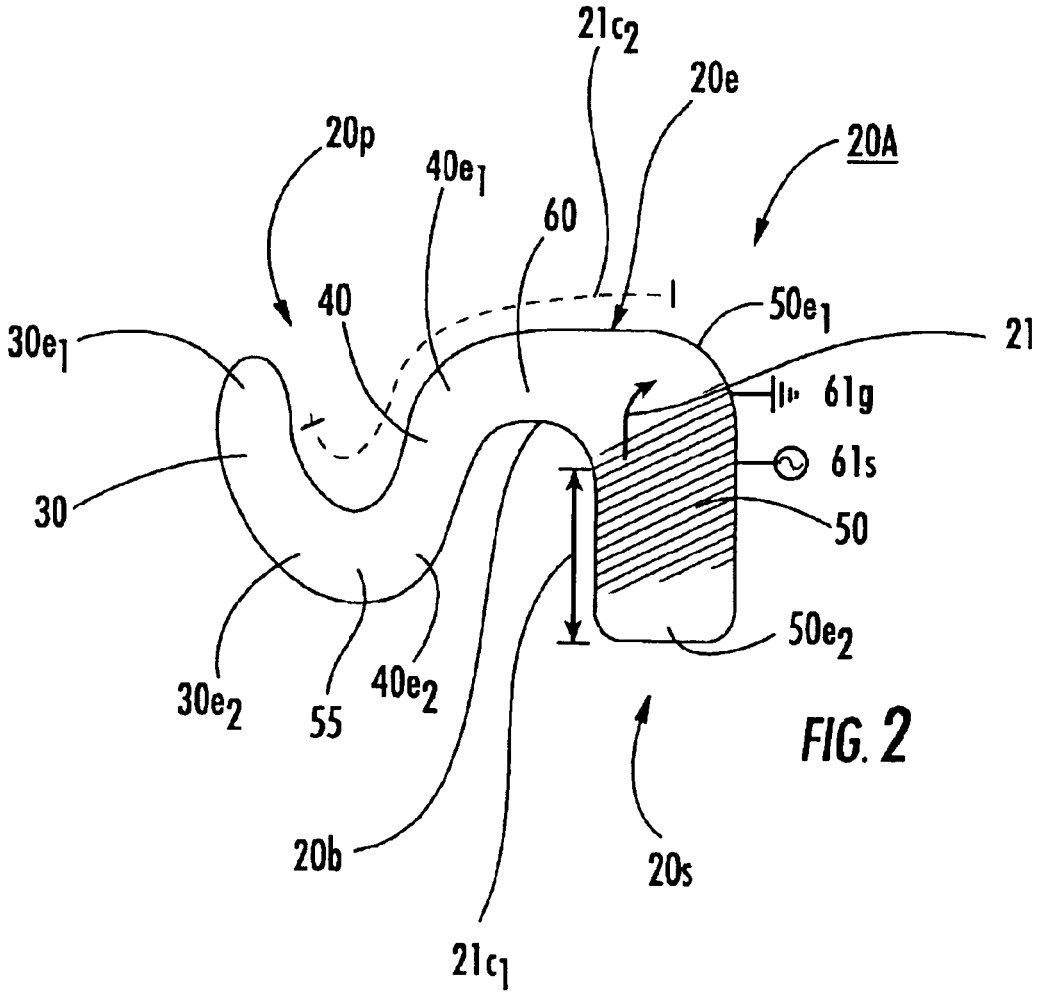
FIG. 2 is a top view of a planar inverted-F antenna according to embodiments of the present invention.
Figure 7:
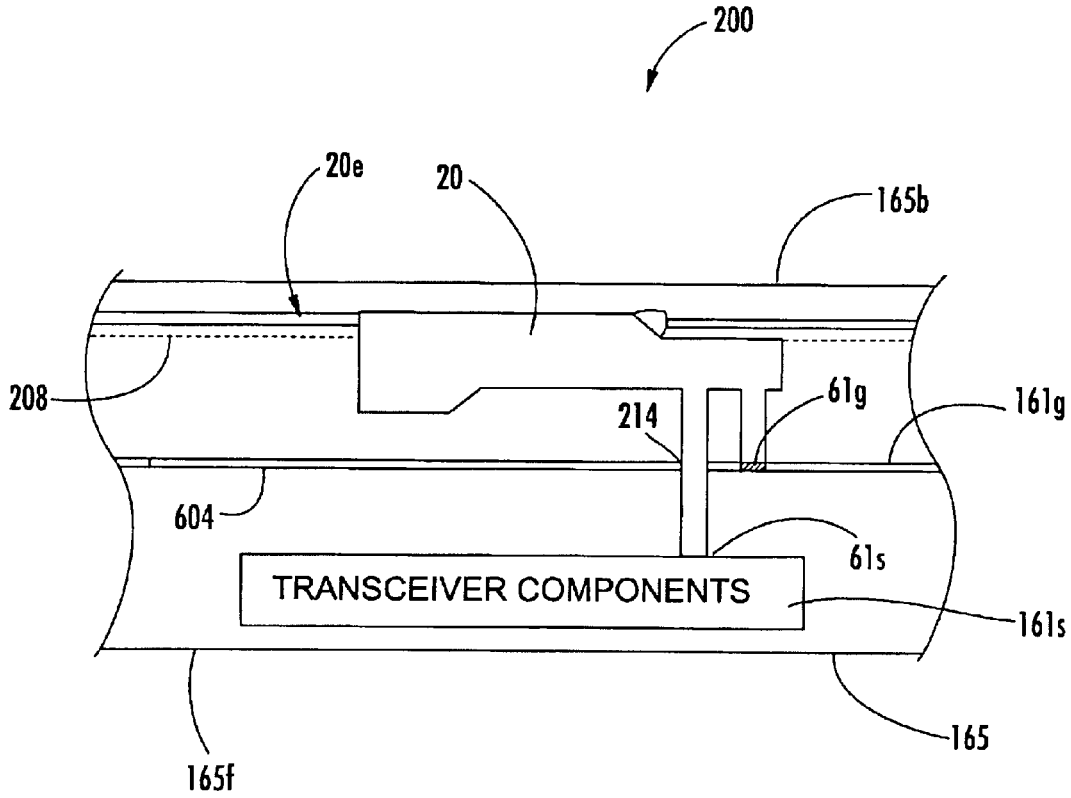
FIG. 7 is a partial side view of a wireless communication device according to embodiments of the present invention.

Referring now to FIG. 2, as illustrated, the antenna 20A includes a conductive element 20*e* that is maintained in spaced apart relationship with a ground plane (FIG. 7, 161*g*). The illustrated conductive element 20*e* has a primary branch 20*p* and a secondary branch 20*s* joined by a bend segment 20*b*. The antenna element 20*e* is in communication with a signal feed 61*s* and a ground feed 61*g*. The signal and ground feeds 61*s*, 61*g* are positioned adjacent each other and disposed on a common edge portion of the element 20*e*. In certain embodiments, the signal and ground feeds 61*s*, 61*g* are positioned on or in proximity to a common portion of the conductive element 20*e*. In particular embodiments, the signal and ground feeds 61*s*, 61*g* are positioned proximate a common outer edge portion. The term "common outer edge portion" means the signal and ground feeds 61*s*, 61*g* are positioned adjacent each other near or on an outside or end portion of the conductive element 20*e* (with no conductive element spacing them apart). This configuration is in contrast to where the ground is positioned on a first portion of the element and the signal across from the ground with an expanse of conductive element that separates the signal and feed (such as for center fed configurations). The primary branch 20*p* is positioned further away from the signal and ground feeds 61*s*, 61*g* than the secondary branch 20*s*, as the two branches 20*p*, 20*s* are joined by the intermediately positioned bend segment 20*b*.

As shown in FIG. 2, the secondary branch 20*s* is positioned with respect to the ground feed 61*g* and signal feed 61*s* so as to have a current path $\mathbf{21}c_1$ that is shorter than the current path $\mathbf{21}c_2$ of the primary branch 20*p*. It is noted that the lengths of the current paths are shown for comparison in FIG. 2: in operation, the actual length, configuration and particular current path vectors associated with the path that the current travels during radiation can vary from that shown. In addition, the current may travel along only a portion of the length of the respective branches 20*p*, 20*s*. Typically, when both branches are fully radiating, current flows over at least a major portion of each branch. Similarly, if one branch is intended to be substantially non-radiating, current does not flow or flows in a reduced amount (such as over a minor portion of the length of the branch). For example, in low band operation, current may flow in the secondary branch 20*s*, but if so, only about a minor portion of that branch and/or in a reduced amount relative to that in high band.

The bend segment 20*b* bridges or joins respective end portions of the two branches 20*p*, 20*s*. In certain embodiments, the primary and secondary branches, 20*p*, 20*s*, respectively, are each separately electrically fed by the signal and ground feeds 61*s*, 61*g* without requiring capacitive coupling therebetween. The non-joined end portions of the branches (shown in this embodiment as $\mathbf{50}e_2$ and $\mathbf{30}e_1$) can be spaced apart a sufficient distance from each other so as to be able to insulate them from parasitically coupling during operation. Stated differently, the element 20*e* can be configured so that the primary branch 20*p* is activated by the ground and signal feeds 61*g*, 61*s* during low band operation without coupling to the secondary branch 20*s*. During high band operation, the primary and secondary branches 20*p*, 20*s* are both activated by the ground and signal feeds 61*g*, 61*s* with the two branches 20*p*, 20*s* configured to radiate independently at the desired frequency band(s) without requiring proximity (parasitic or capacitive) coupling therebetween. Although, in certain embodiments, supplemental parasitic coupling between segments of the primary and secondary branches 20*p*, 20*s* may be used as will be discussed further below.

The conductive element 20*e* bend segment 20*b* can be configured and positioned with respect to the signal and ground feeds 61*s*, 61*g* to define a current null space 21 provided by a relatively high impedance node in the conductive element 20*e* current path during high band operation. The high impedance node (and, thus current null) allows the resonances of the two branches to combine during high band operation. Impedance (Z) can be described as the voltage (V) divided by the current (I), (i.e., Z=V/I). At the feed point or location, current (I) is at a maximum and hence, impedance (Z) is low. At the low current (I) point, shown as 20*b*, current (I) can approach zero and the impedance (Z) increases correspondingly. Thus, the high impedance node is the location in the current path where current approaches zero.

Figure 4:
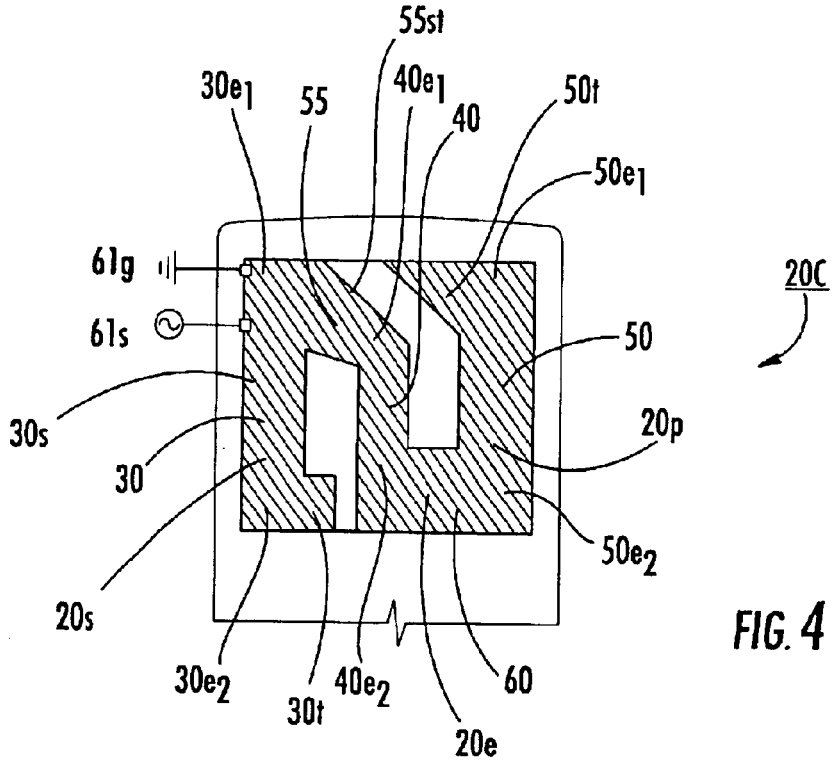
FIG. 4 is a top view of a planar inverted-F antenna according to other embodiments of the present invention.

Typically, the high impedance node is located proximate the signal and ground feeds 61*g*, 61*s* about the bend segment 20*b* on branch 20*p*. The bend segment 20*b* can be positioned at about 4–15 mm from the feed location to provide a suitable radiating pattern. The distance from the feed and ground 61*s*, 61*g* to the bend segment 20*b* can be measured from where the feed and ground segments 61*s*, 61*g* contact the main radiating element 20*p*. If the feed and ground probes were connected, the bend segment 20*b* can be generally placed substantially perpendicular to the feed and ground 61*s*, 61*g* as shown in FIGS. 2 and 4.

In operation, in certain embodiments, the secondary branch 20*s* can form about a ¼ wave resonator at the high frequency band. The primary branch 20*p* can form about a ¼ wave resonator at the low frequency band. At high band operation, the configuration of the element 20*e* with the positioning of the signal feed 61*s* and ground feed 61*g* causes the primary and secondary branches 20*s* and 20*p* to resonate. A ½ wave resonance is formed between the bend 20*b* and $\mathbf{30}e_1$ at high band. A ¼ wave resonance is formed on element 50. Thus, the antenna 20 operates at both low and high frequency bands of operation such that at low band, current flow in the secondary path $\mathbf{21}c_1$ is reduced relative to current flow therein during the high band of operation (where current flows in both the primary and secondary branches).

The ½ wave resonator can be tuned by adjusting the length and/or geometry of the high band (secondary) branch. During high band operation, the two resonances of the primary and secondary branches 20*p*, 20*s* can be combined to allow for a single, wider resonance band. In certain embodiments, because edge proximity capacitive coupling (such as those used in center fed C configurations) is not required, low-band performance may be improved relative to conventional designs. A substantial portion of the conductive element 20*e* can be configured to resonate at high-gain providing a relatively high band antenna. This additional gain may also allow a lower Z-height antenna to be used relative to past configurations. In addition, since conductive element embodiments of the present invention employ multiple high-band resonators, the VSWR at high band may be improved.

Still referring to FIG. 2, the conductive element 20*e* can be further described as a planar conductive element that includes first, second and third elongated branch segments, 30, 40, and 50, respectively. Each of the elongate branch segments 30, 40, 50 has opposing first and second end portions $\mathbf{30}e_1$, $\mathbf{30}e_2$, $\mathbf{40}e_1$, $\mathbf{40}e_2$, and $\mathbf{50}e_1$, $\mathbf{50}e_2$. As shown, the first, second and third elongate segments 30, 40, 50 are spaced apart from each other with the second elongated segment 40 being intermediate of the first 30 and third 50 elongated segments. The conductive element 20*e* further includes a first bend segment 55 extending between the first and second elongated segments 30,40 at a corresponding one of the first or second end portions thereof (shown at the second end portions $\mathbf{30}e_2$, $\mathbf{40}e_2$) and a second bend segment 60 extending between the second 40 and third 50 elongated segments at the other corresponding end portion (shown at the first end portions $\mathbf{40}e_1$, $\mathbf{50}e_1$). The signal feed 61*s* and ground 61*g* are electrically connected to the conductive element 20*e* at an outer edge portion thereof. The primary and secondary branches 20*p*, 20*s* can each be conductively coupled to the signal and ground 61*s*, 61*g* (the primary branch 20*p* via bend segment 20*b*).

The antenna 20 is configured to operate at least first and second different resonant frequency bands. The conductive element 20*e* and the first and/or second bend segments 55, 61 are configured to generate at least one current null space in the current path during one of the first or second bands of operation as described above. Typically, the current null space is generated in the high band operation at a position that allows the separate resonances of the two branches 20*p*, 20*s* to combine.

In this embodiment, the secondary branch 20*s* is defined by the third elongated segment 50 with the primary branch 20*p* including elongated segments 30, 40, bend segment 55, and may include a portion of bend segment 60. In certain embodiments, some current may flow into segment 50 during low band operation, but this segment 50 is configured to primarily resonate (over a major portion of its length) during high band operation.

Figure 3A:
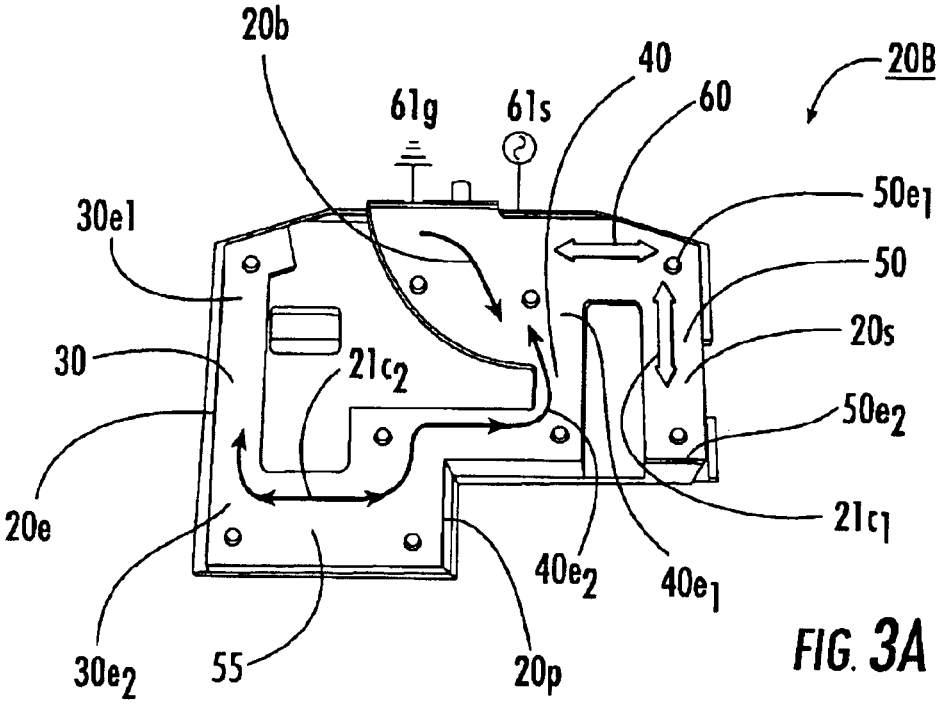
FIG. 3A is a top view of a planar inverted-F antenna according to additional embodiments of the present invention.
Figure 3B:
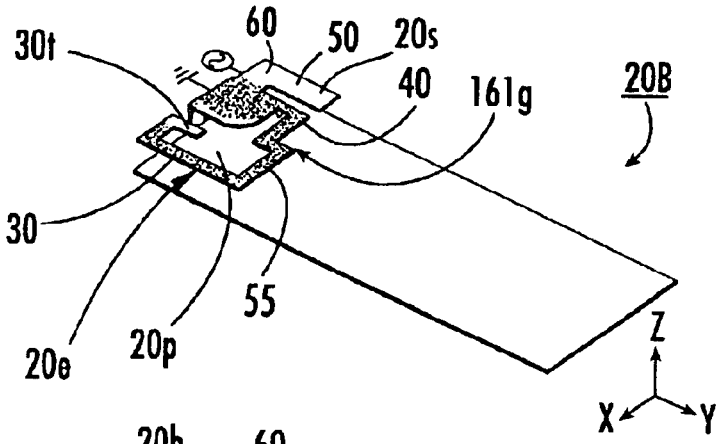
FIG. 3B is a side perspective view of the excitation of the antenna of FIG. 3A at low band operation according to embodiments of the present invention.
Figure 3C:
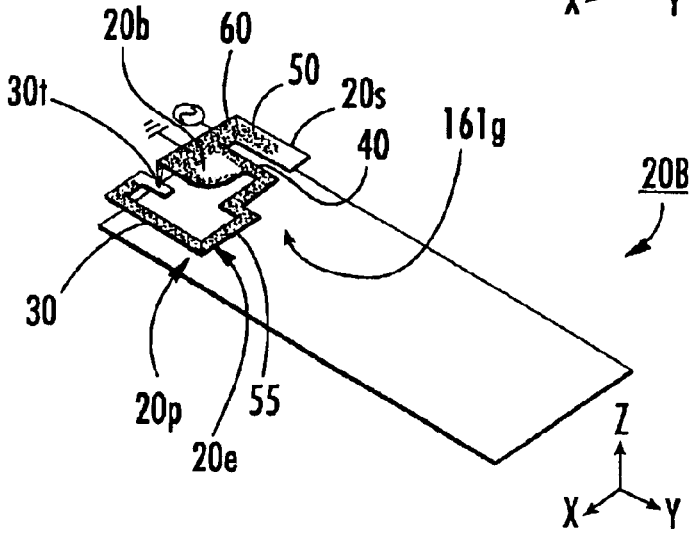
FIG. 3C is a side perspective view of the excitation of the antenna of FIG. 3A at high band operation according to embodiments of the present invention.

FIGS. 3A–3C illustrate another embodiment of the present invention. As shown, the signal and ground feeds 61*s*, 61*g* are positioned about the bend segment 20*b* that is located intermediate the primary and secondary branches 20*p*, 20*s*. FIGS. 3B and 3C illustrate a circuit board defining the ground plane 161*g*. As for the embodiment discussed above, the conductive element 20*e* can be configured with three spaced apart elongated segments 30, 40, 50 joined by bend segments 55, 60 and the signal and ground 61*s*, 61*g* can be positioned about a common outer edge portion of the conductive element 20*e* proximate the second segment end portion $\mathbf{40}e_1$. The signal and ground 61*s*, 61*g* can also be positioned at other locations (for this and the other embodiments shown and/or described herein), such as inside of the outer edge portion. The secondary branch may include a tuning segment 30*t* as shown in FIGS. 3B and 3C. The primary branch 20*p* includes a portion of the bend segment 60 as well as bend segment 55 and first and second elongate segments 30, 40. The secondary branch 20*s* includes the third elongate segment 50.

The darker shaded or cross-hatched portion of the conductive element 20*e* shown in FIG. 3B illustrates the current flow path and/or radiating portion of the element during low band operation, with the primary branch 20*p* radiating and secondary branch substantially free of radiation. The shaded portion of the conductive element 20*e* shown in FIG. 3C illustrates the current flow and/or radiating portion of the element 20*e* at high band operation with the primary and secondary branches 20*p*, 20*s* radiating. This embodiment may provide omni-directional gain at high band.

FIG. 4 illustrates an embodiment of the present invention similar to that shown in FIG. 2 (a mirrored pattern configuration). Thus, the same functional output can be achieved. As shown the antenna 20C includes a conductive element 20*e* with primary and secondary branches 20*p*, 20*s*. In this embodiment, the first elongate segment 30 defines the secondary branch 20*s*. The signal and ground feeds 61*s*, 61*g* are positioned about a common outer edge portion of the first segment 30. The first bend segment 50 can join first edge portions $\mathbf{30}e_1$, $\mathbf{40}e_1$, of the first and second elongate 30, 40 segments. The second bend segment 60 can join the second end portions $\mathbf{40}e_2$, $\mathbf{50}e_2$ of elongate segments 40, 50. The first bend portion 55 may include a step that angularly extends down toward the second segment 40. The first segment 30 may include a tuning component 30*t* as shown in FIG. 4. The second segment 40 may be bent toward the third segment 50 (shown as the right branch) to tune the high band resonance lower to meet the desired operational frequency and desired dimensional configuration. The antenna element may be configured with about a 31 mm width×29 mm height×about a 6 mm depth. Additional depth may provide additional performance advantages.

Figure 5A:
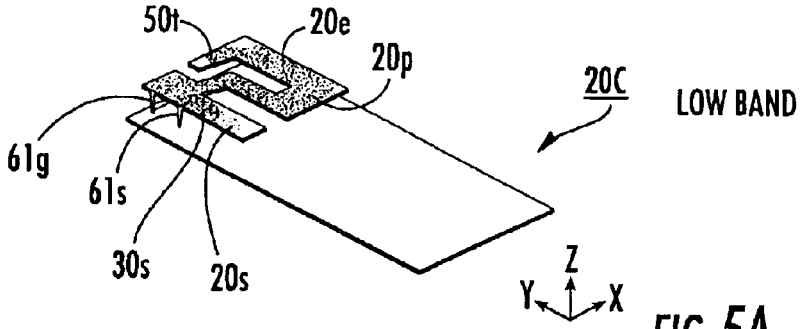
FIG. 5A is a side perspective view of the excitation of the antenna of FIG. 4 at low band operation according to embodiments of the present invention.
Figure 5B:
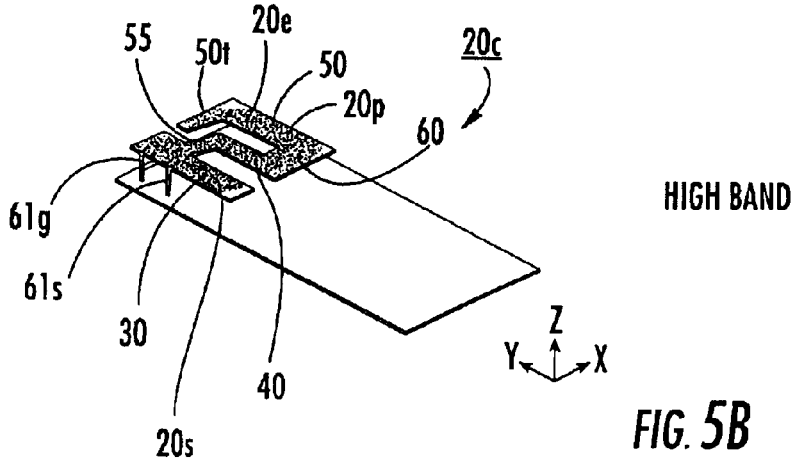
FIG. 5B is a side perspective view of the excitation of the antenna of FIG. 4 at high band operation according to embodiments of the present invention.

Similarly, the third segment 50 may also include a tuning element 50*t* as shown in FIGS. 4 and 5A, 5B. FIGS. 5A and 5B illustrate that the third segment tuning element 50*t* may turn back toward the second segment 40 and/or bend 55. In certain embodiments, the third segment tuning component 50*t* may be sized and configured to capacitively couple with the second segment 40 or bend 55.

The darker shaded or cross-hatched portion of the conductive element 20*e* shown in FIG. 5A illustrates the current flow path and/or radiating portion of the element during low band operation, with the primary branch 20*p* radiating and secondary branch 20*s* having reduced radiation (at least compared to high band as shown in FIG. 5B). The shaded portion of the conductive element 20*e* shown in FIG. 5B illustrates the current flow and/or radiating portion of the element 20*e* at high band operation with the primary and secondary branches 20*p*, 20*s* radiating.

Figure 6A:
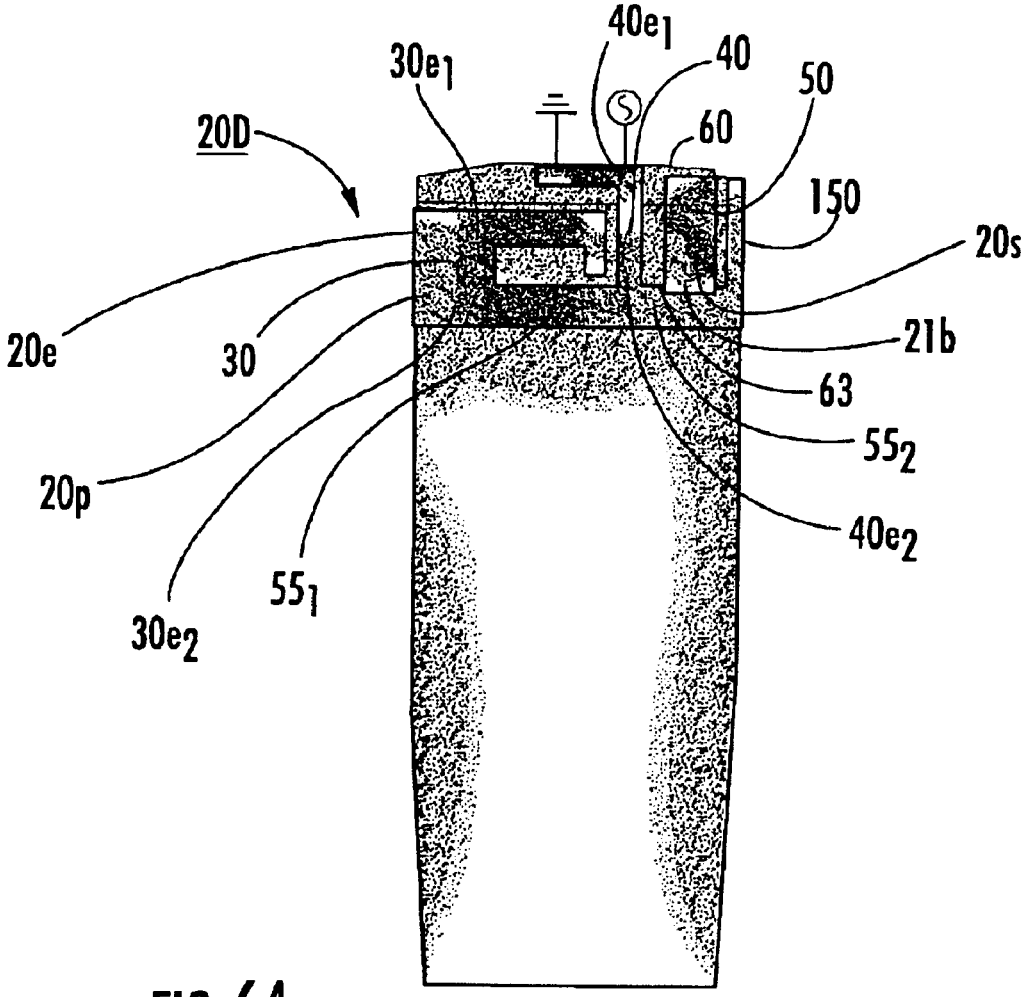
FIG. 6A is a top view of a planar inverted-F antenna according to still further embodiments of the present invention.

FIG. 6A illustrates another embodiment of the present invention. As shown, the antenna 20D includes conductive element 20*e*. Similar to the embodiment shown in FIG. 3A, the signal and ground feeds 61*s*, 61*g* are positioned intermediate the primary and secondary branches 20*p*, 20*s*. However, this embodiment is configured to provide a third resonance. The third resonance may be used for any suitable application, such as, but not limited to GPS or Bluetooth systems. Thus, the antenna 20D may provide two different high band modes along with a low band mode of operation. In this embodiment, the primary branch 20*p* includes the first segment 30, a first bend segment $\mathbf{55}_1$, the second segment 40 (which connects to the signal and ground 61*s*, 61*g*), a second bend segment $\mathbf{55}_2$, and a fourth segment 150. The second segment 40 and spaced apart bend segments $\mathbf{55}_1$, $\mathbf{55}_2$ can be described as an inverted "T" configuration. The secondary branch 20*s* includes segment 50 that connects to the signal and ground feeds 61*s*, 61*g*, via bend segment 60.

The secondary branch 20*s* can include a supplemental proximity coupling (capacitively or parasitically coupled) 216 to the primary branch 20*p*. As shown, the secondary branch 20*s* is proximity coupled connected at the end portion away from the signal feed 61*s* at bend segment 63.

Figure 10A:
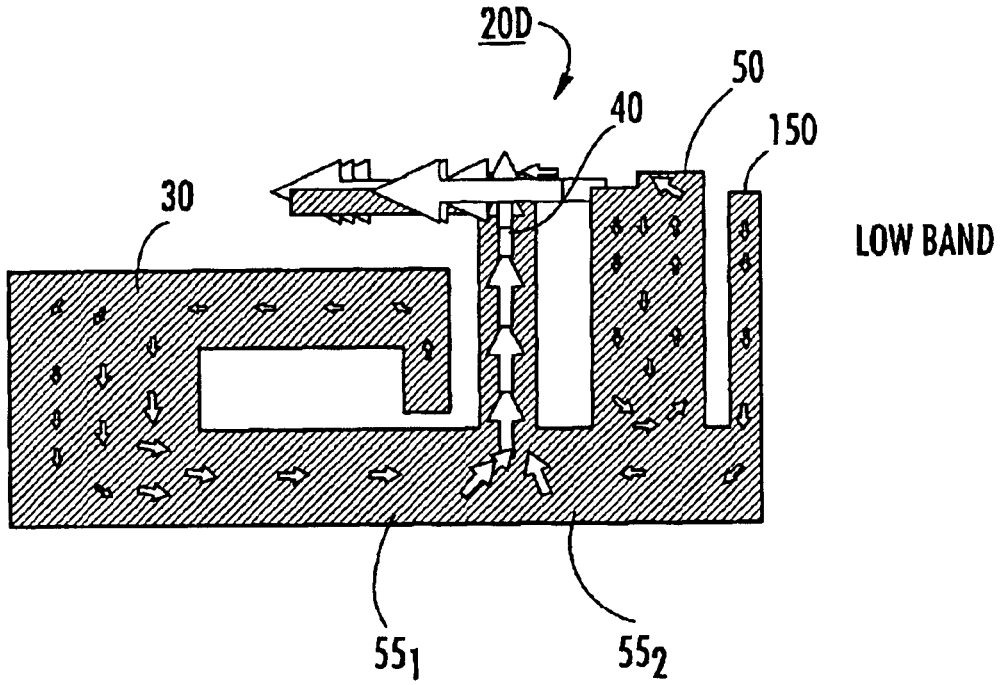
FIG. 10A is a current vector plot of the antenna shown in FIG. 6A at a low-band (894.5 MHz).
Figure 10B:
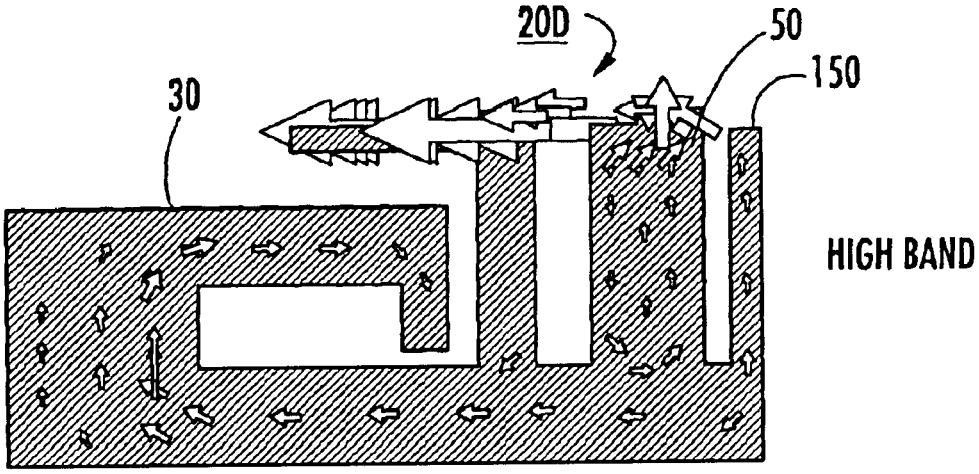
FIG. 10B is a current vector plot of the antenna shown in FIG. 6A at a high band (1.9973 GHz).

FIGS. 10A and 10B illustrate exemplary current vector plots for the antenna 20D shown in FIG. 6A. FIG. 10A illustrates the current flow at one low band frequency (894.595 MHz) and FIG. 10B at one high band frequency (1.9973 GHz). As shown in FIG. 10B, at high band, the branch 50 radiates because it is a resonant length. The branch 150 also has some current that is induced by capacitive coupling of the top portion of branch 50. The first (left) branch 30 is also radiating. The radiation is caused by the impedance match presented by the right branch 150. As shown in FIG. 10A, at low band, the primary radiation and current path is through the center segment 40. The current branches along each side of the center segment 40 and segments 30, 150 to both sides of the center segment 40 and each provide some radiation. The radiation of the segment 50 is attributed to the proximity coupling 216 to the "inverted T" configuration defined by the center segment 40 and bend regions $\mathbf{55}_1$, $\mathbf{55}_2$. Absent the proximity coupling 216, there would be very little low band current in the secondary branch 50.

Figure 6B:
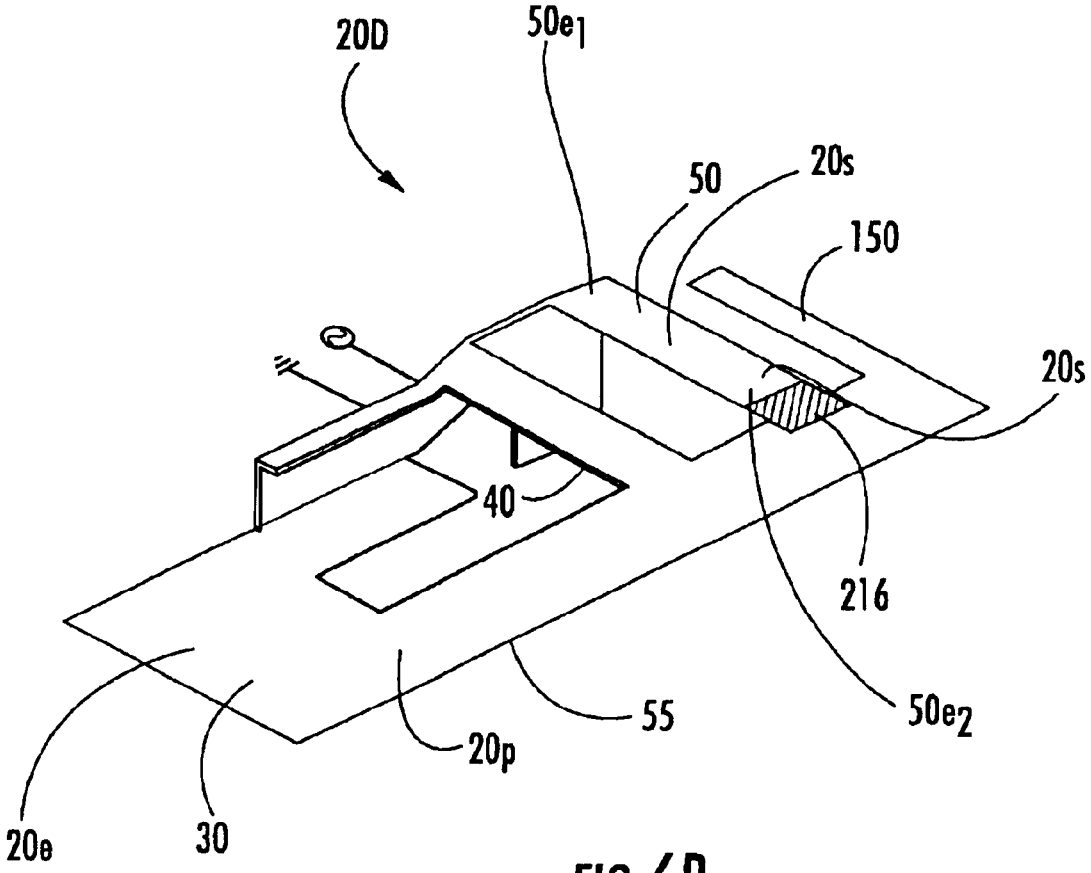
FIGS. 6B and 6C are opposing side perspective views of an exemplary configuration of the antenna shown in FIG. 6A according to embodiments of the present invention.

FIG. 6B illustrates one example of a conductive element 20*e* configuration for the antenna embodiment 20D shown in FIG. 6A. The primary branch 20*p* connects the second segment 40 and includes segments 30, 40 and 150. In this embodiment, the primary radiating branch 20*p* can create one base resonance at a fundamental frequency, roughly in the 800–900 MHz range, useful for certain cellular systems. In this particular embodiment, the antenna has a second base resonance frequency at approximately twice the fundamental frequency, approximately at 1,900 MHz. The bandwidth of the antenna in this area is great enough to accommodate both the 1,900 MHz band and the 1,800 MHz band.

Figure 6C:
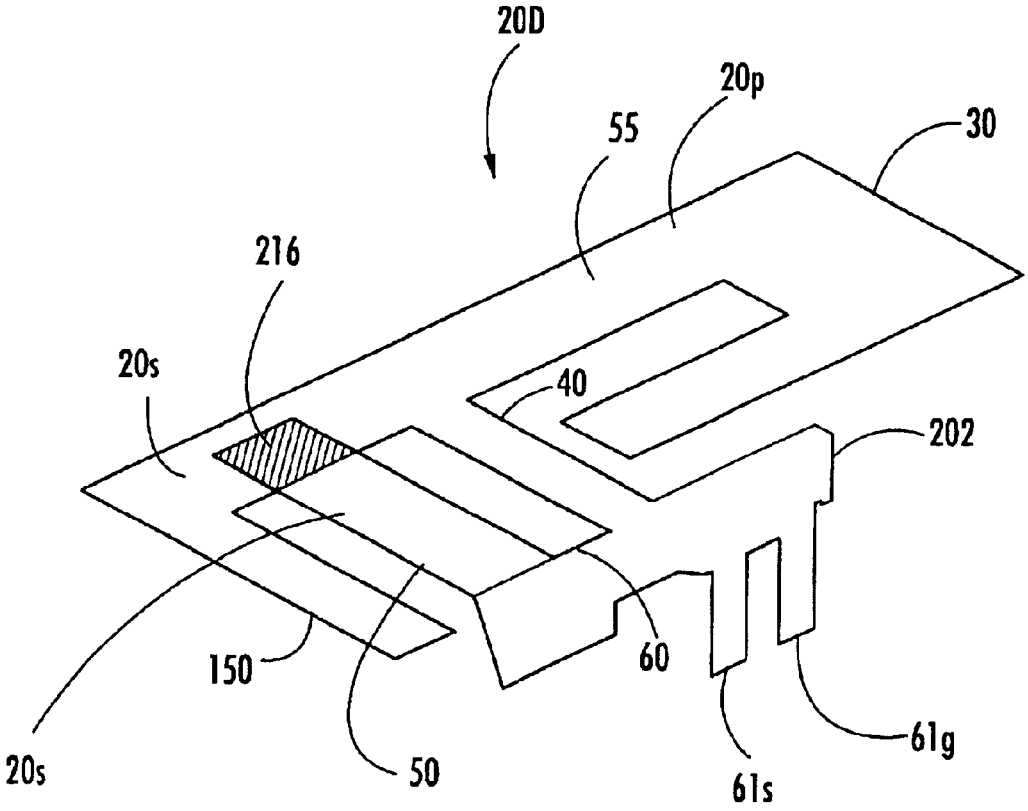

In the embodiment of FIG. 6A–6C, the antenna 20D secondary branch 20*s* has a first end $\mathbf{50}e_1$ which is connected to the signal feed 61*s* and ground feed 61*g* proximate to where the primary radiating branch 20*p* is connected. The secondary branch 20*s* includes a second end $\mathbf{50}e_2$, which capacitively couples 216 the secondary radiating branch 20*s* to the primary radiating branch 20*p*. The capacitive coupling 216 can be adjusted to create an additional resonance, which is not necessarily harmonically related to the base resonances of the antenna. In this particular example, the additional resonance is for the global positioning system (GPS) as the terminal into which this antenna is to be built, will include a GPS receiver. GPS operates at approximately 1,575 MHz. GPS is well-known to those skilled in the art. GPS is a space-based triangulation system using satellites and computers to measure positions anywhere on the earth. Compared to other land-based systems, GPS is less limited in its coverage, typically provides continuous twenty-four hour coverage regardless of weather conditions, and is highly accurate. In the current implementation, a constellation of twenty-four satellites orbiting the earth continually emit the GPS radio frequency. The additional resonance of the antenna as described above permits the antenna to be used to receive these GPS signals.

In FIGS. 6A–6C, the capacitive coupling 216 between the first branch and the second branch of the antenna is created by an overlapping area, shown in cross-hatch. An underlapping area can be used and would work in the same way. To a first approximation, a parallel plate capacitor is formed at the overlapping or underlapping area. The amount of capacitance, and hence the amount of coupling and the additional resonance frequency, can be controlled by controlling the distance between the branches in the cross-hatched area, and the size of the area. This control, in effect, manipulates variables in the formula that are well-known for parallel plate capacitors:

$$C = \frac{\varepsilon_0 A}{d},$$

where C is the capacitance in Farads, A is the area of the plates, corresponding to the overlap/underlap area, d is the distance between the plates, corresponding to the distance between the first and second radiating branches, and $\epsilon_0$ is the permitivity constant.

FIG. 6C illustrates the PIFA shown in FIG. 6B from a different angle. This view also displays the overlap of the cross-hatched area at the second end $\mathbf{50}e_2$ of the secondary radiating branch 20*s* of the antenna 20D. Additionally, in this view, signal feed conductor 204 is more visible and ground feed conductor 61*g* is visible. Again, although in this example the second radiating branch is overlapping the first radiating branch, the same effect could be achieved by having the second radiating branch "underlap" the first radiating branch. The term "overlap" if used by itself in this disclosure is intended to encompass both possibilities.

Figure 6D:
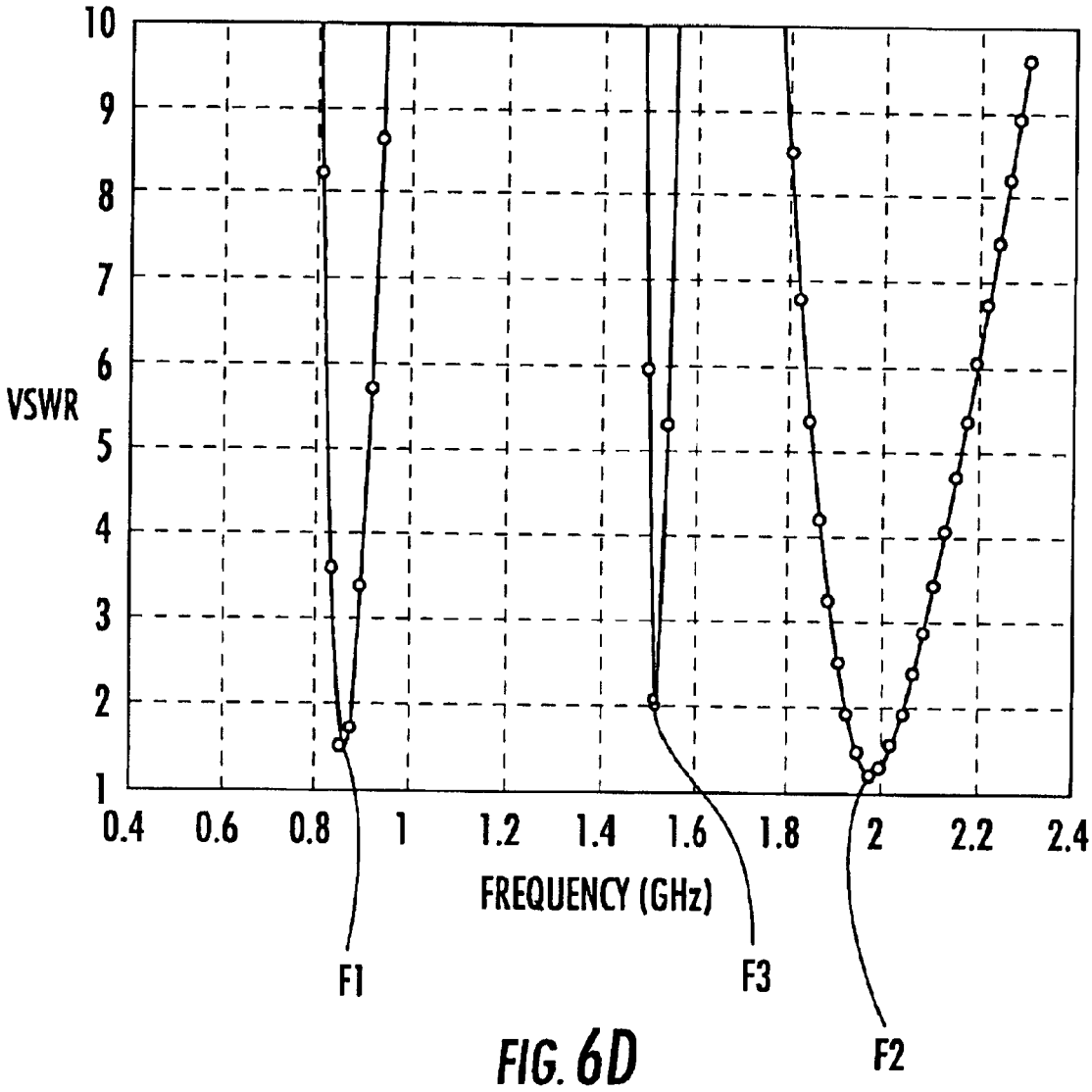
FIG. 6D is a VSWR plot of the antenna shown in FIG. 6A according to embodiments of the present invention.

FIG. 6D is a graph illustrating the VSWR for the antenna illustrated in FIG. 6A as a function of frequency. However, it should be noted that the antenna 20D of FIG. 6A has three resonance frequencies (F1, F2, F3), each clearly visible as a local minimum in the VSWR curve. The particular antenna 20D illustrated has two base resonance frequencies as previously mentioned, occurring at approximately 900 MHz and 1,900 MHz, respectively. The additional resonance (F3) is for 1,575 MHz, and is visible as the local minimum.

It is noted that the capacitive coupling 216 between the primary radiating branch 20*p* and the secondary radiating branch 20*s* can be provided by a separate "parasitic" conductor (not shown) which may be installed with adhesive or otherwise structurally supported by the housing of the radiotelephone terminal. Again, this parasitic conductor could be either over or under the radiating branches as shown in this view. The parasitic does not have to be rectangular, but could vary in shape as well as size. Essentially all of the parasitic conductor area, with the exception of the portion that falls directly over the small space between the two radiating branches is capacitively coupled with one or the other of the two branches, as the case may be. Again, the area of capacitive coupling and the distance between the parasitic conductor and the branches can be adjusted to tune the additional resonance, based on the formula previously discussed, except that a designer is essentially dealing with two capacitors in series. Additional tuning extensions 30*t*, 150*t*, and the like (not shown) can be added to the primary radiating branch to achieve appropriate resonances.

Figure 6E:
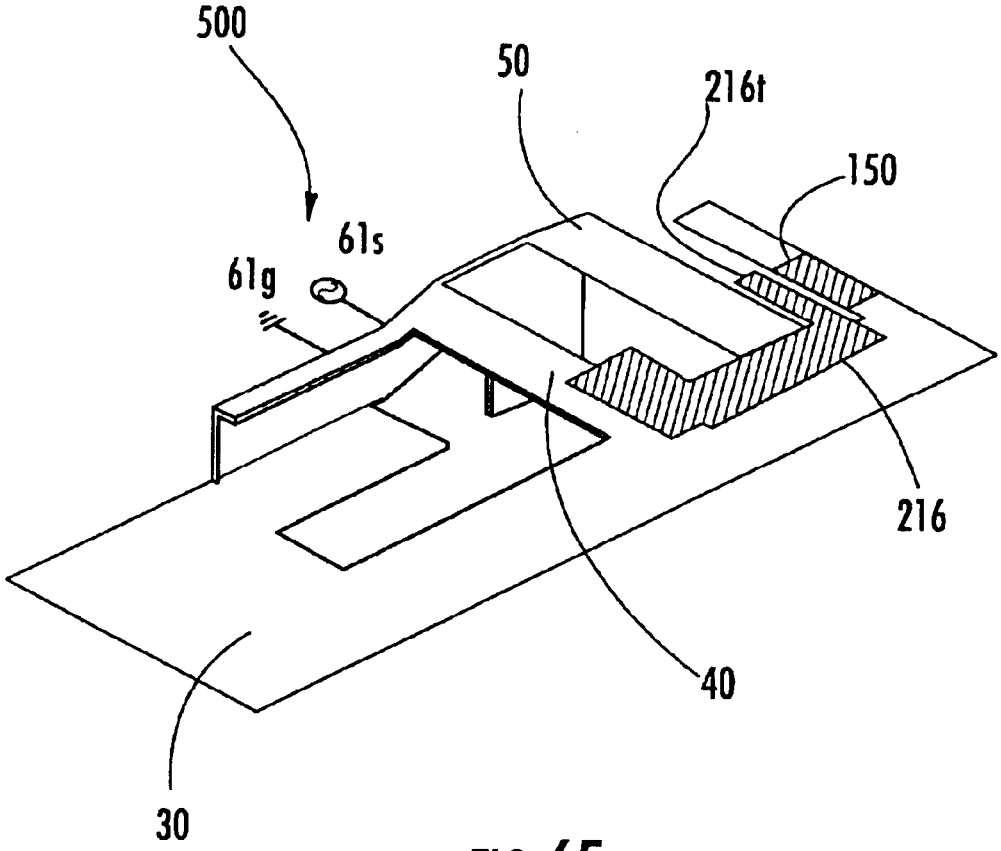
FIG. 6E is a side perspective view of an additional exemplary configuration for the antenna shown in FIG. 6A according to embodiments of the present invention.

FIG. 6E illustrates an example of an additional tuning extension 216*t* can also be added to the secondary branch 20*s* at the coupling 216. In certain embodiments, the tuning for this member can be a U-shaped extension that creates an extended length coupling area for the secondary radiating branch 20*s* with an edge that runs generally parallel to and in substantially close proximity to the primary radiating branch 20*s* (about segments 40, 63 and 150). This pattern creates an area of capacitive coupling involving areas of the two radiating branches as marked in cross-hatch. It will be appreciated by those of skill in the art that this, in effect, creates a parallel plate capacitor "on its side" in which the thickness of the conductors of the antenna multiplied by the length of adjacency effectively defines the area of the capacitor, for application via the mathematical relationship previously described. It must be noted that this particular extension to the second radiating branch is shown by way of example only. It is possible to devise an antenna with radiating branches of other irregular shapes that can cause specific areas of the edges of the radiating branches to come in close proximity to each other for particular distances along the edges.

Referring now to FIG. 7, a conventional arrangement of electronic components that allow a wireless terminal to transmit and receive wireless terminal communication signals will be described in further detail. As illustrated, an antenna for receiving and/or transmitting wireless terminal communication signals is electrically connected to transceiver circuitry components 161*s*. The components 161*s* can include a radio-frequency (RF) transceiver that is electrically connected to a controller such as a microprocessor. The controller can be electrically connected to a speaker that is configured to transmit a signal from the controller to a user of a wireless terminal. The controller can also electrically connected to a microphone that receives a voice signal from a user and transmits the voice signal through the controller and transceiver to a remote device. The controller can be electrically connected to a keypad and display that facilitate wireless terminal operation. The design of the transceiver, controller, and microphone are well known to those of skill in the art and need not be described further herein.

The wireless communication device 200 shown in FIG. 7 may be a radiotelephone type radio terminal of the cellular or PCS type, which makes use of an antenna 20 according to embodiments of the present invention. As shown, the device 200 includes a signal feed 61*s* that extends from a signal receiver and/or transmitter (e.g., an RF transceiver) comprising electronic transceiver components 161*s*. The ground plane 161*g* serves as the ground plane for the planar inverted-F antenna 20. The antenna 20 may include a dielectric substrate backing shown schematically by dotted line 208. The antenna 20 can include wrapped portions 212 which serve to connect the conductive element 20*e* to the signal and ground feeds 61*s*, 61*g*. The ground feed 61*g* is connected to the ground plane 161*g*. The antenna 20 can be installed substantially parallel to the ground plane 161*g*, subject to form shapes, distortions and curvatures as might be present for the particular application, as previously discussed. The signal feed 61*s* can pass through an aperture 214 in the ground plane 161*g* and is connected to the transceiver components 161*s*. The transceiver components 161*s*, the ground plane 161*g*, and the inverted-F antenna 20 can be enclosed in a housing 165 for the wireless (i.e., radiotelephone) terminal. The housing 165 can include a back portion 161*b* and front portion 161*f*. The wireless device 200 may include other components such as a keypad and display as noted above. The ground plane 161*g* may be configured to underlie or overlie the antenna 20.

It is noted that the branch pattern configurations of the antennas 20 shown herein may be re-oriented, such as rotated 90, 180 or 270 degrees. In addition or alternatively, the configurations may be re-oriented in a mirrored pattern (such as left to, right). The antennas 20 may be configured to occupy an area that is less than about 1200 $mm^2$. Typically, the antenna has a perimeter that is less than about 40 mm height×40 mm width×11 mm depth. In certain embodiments, the antenna 20 can be configured to be equal to or less than about 31 mm height and/or width with a depth that is less than about 11 mm (typically 4–7 mm).

Figure 8A:
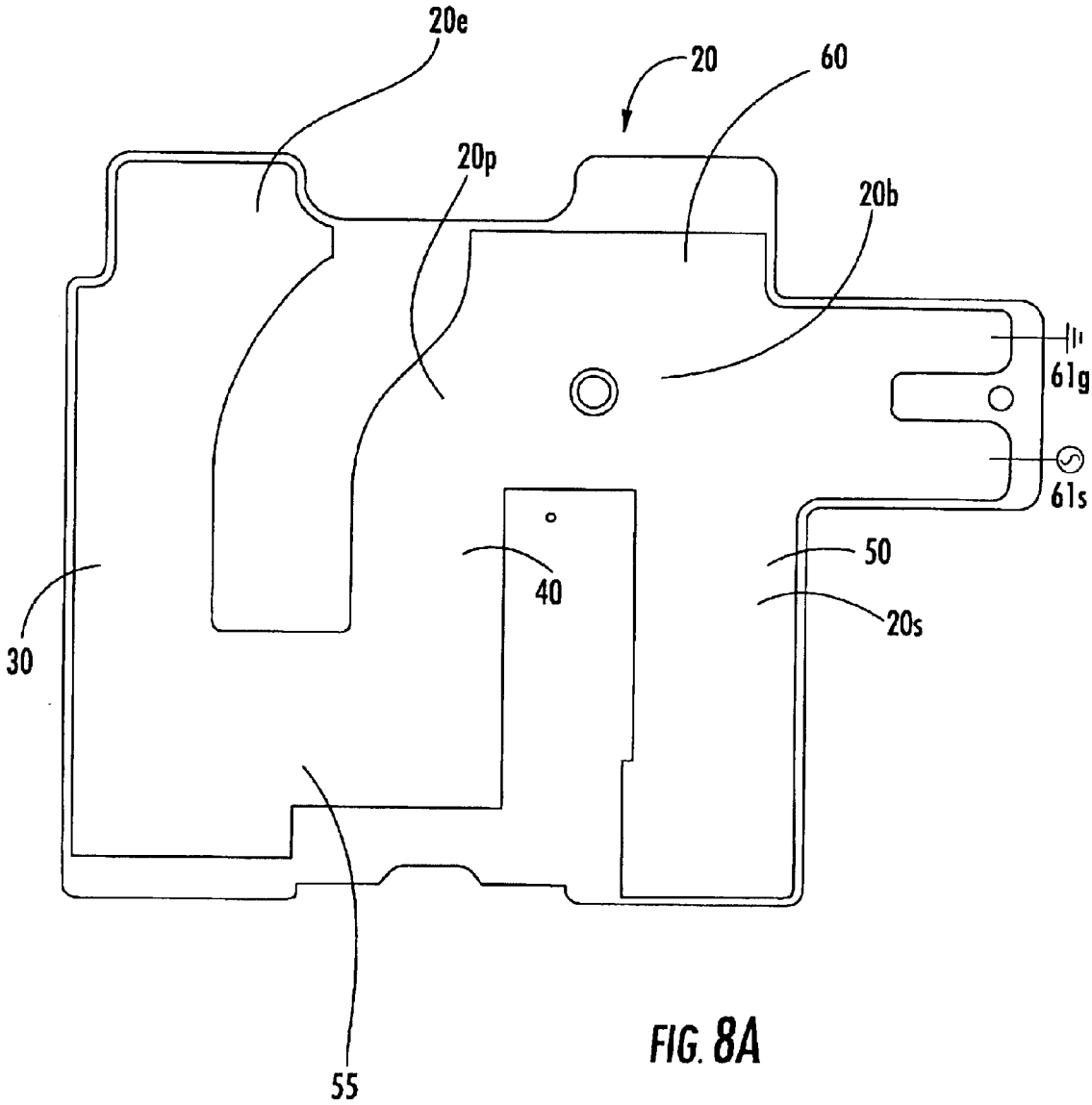
FIG. 8A is a top view of a planar inverted-F antenna according to yet other embodiments of the present invention.
Figure 8C:
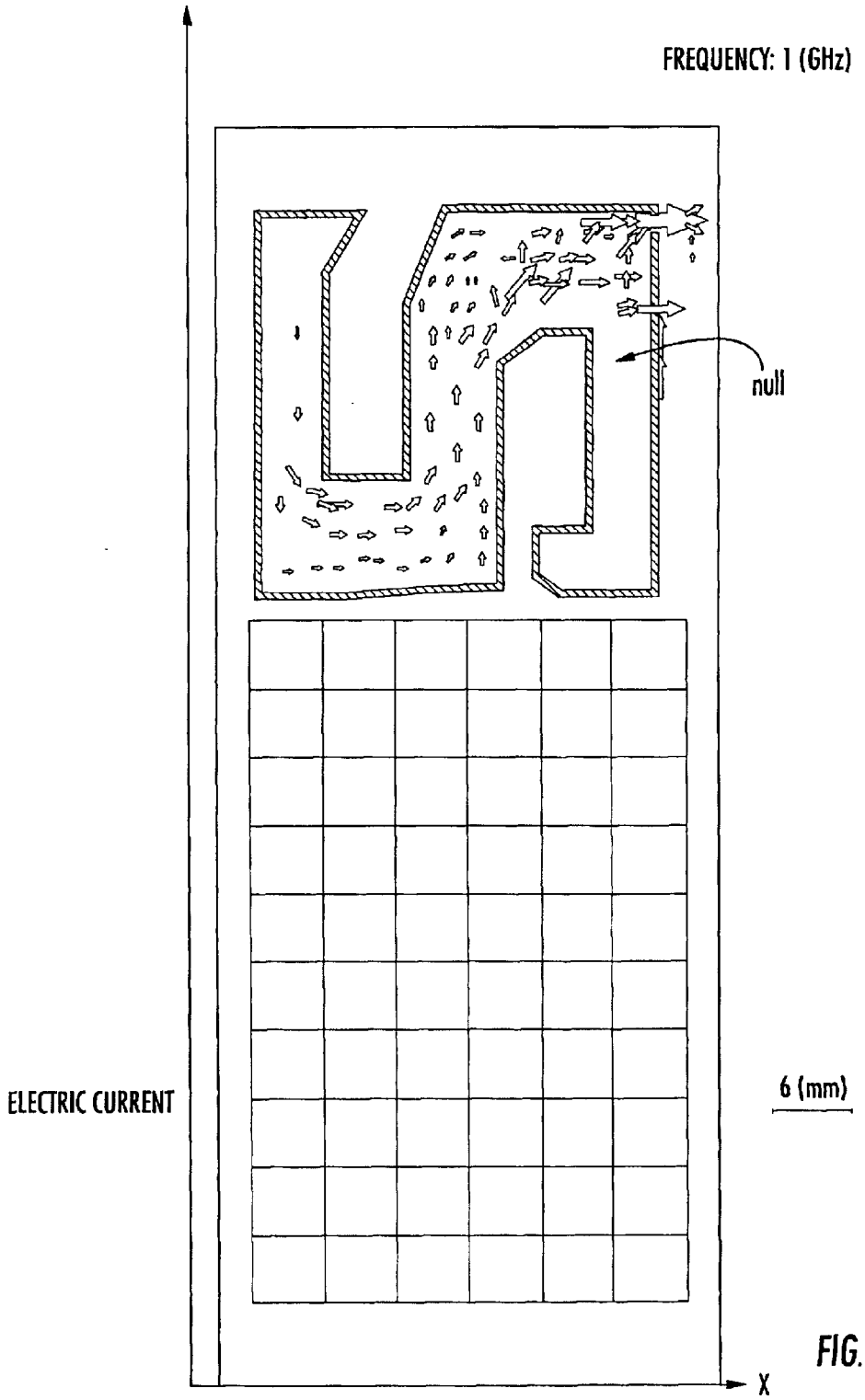
FIG. 8C is a current vector plot of the antenna shown in FIG. 8B at 1.0 GHz.

FIG. 8A is another example of an antenna 20 similar to that shown in FIG. 2 having an antenna element 20*e* according to embodiments of the present invention. FIG. 8B is a current vector plot for the antenna shown in FIG. 8A with the electric current flow at 2.1 GHz. FIG. 8C is the current vector plot for the same antenna at 1.0 GHz. FIG. 8B can be described as representative of the current flow at high band and FIG. 8C as representative of current flow at low band. As shown, the secondary branch 20*s* is substantially free of current flow at low band (with the current null located proximate the bend segment 60 at the signal and ground feed region about the upper end of the segment 50) and radiating with the primary branch 20*p* at high band.

Figure 9:
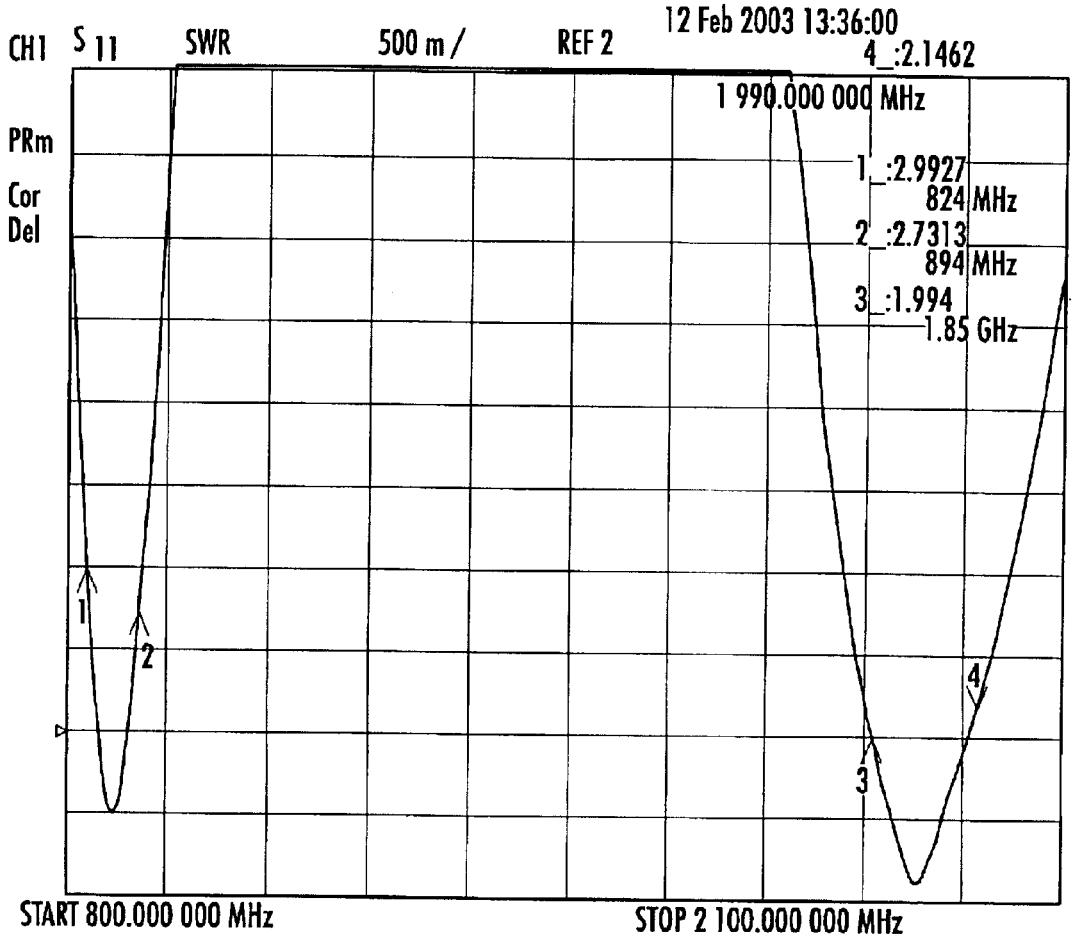
FIG. 9 is a VSWR plot of the antenna configuration shown in FIG. 4 positioned about 6 mm over the ground plane.

FIG. 9 is the VSWR plot of the embodiment shown in FIG. 4. As shown, the plot represents the antenna 20 positioned about 5 mm over the ground plane. VSWR at high-band (1850–1990 MHz) is relatively wide and resonates well. VSWR at low band is slightly narrower than high band, but can be improved with additional height (such as 7–8 mm placement) of the antenna relative to the ground plane.

The operational frequency bands may be adjusted by changing the shape, length, width, spacing and/or state of one or more conductive elements of the antenna. For example, the resonant frequency bands may be changed by adjusting the spacing between the conductive element and the ground element.

In the drawings and specification, there have been disclosed embodiments of the invention and, although specific terms are employed, they are used in a generic and descriptive sense only and not for purposes of limitation, the scope of the invention being set forth in the following claims. Thus, the foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A planar inverted-F antenna having a plurality of resonant frequency bandwidths of operation, comprising:

a signal feed;

a ground feed; and a conductive element in communication with the signal and ground feed, the conductive element comprising:

a primary branch in communication with the signal and ground feeds, the primaiy branch having opposing first and second end portions and a first current path length;

a secondary branch in communication with the signal and ground feeds, the secondary branch having opposing first and second end portions and a second current path length, the length of the second current path being shorter than the length of the first current path; and a bend segment having opposing end portions positioned intermediate the primary and secondary branches configured to join the primary and secondary branches, wherein the secondary branch is conductively coupled to the signal and ground feeds, wherein the primary branch is conductively coupled to the bend segment that is conductively coupled to the signal and ground feeds so that the primary branch radiates at high and low band without requiring capacitive coupling between the primary and secondary branches, wherein the around and signal feeds are positioned adjacent each other proximate a common edge portion of the conductive element, and wherein the bend segment is configured and positioned with respect to the signal and ground and the secondary branch so that in low band operation, current flows into the primary branch but the secondary branch has current flow that is substantially reduced from that in high band operation and so that, in high band operation, current flows in at least a major portion of both the primary and secondary branches.

2. An antenna according to claim 1, wherein the ground and signal feeds are positioned adjacent each other proximate a common outer edge portion of the conductive element proximate the bend segment and/or first end portion of the secondary branch, with the signal feed being disposed closer to the secondary branch and the ground feed being disposed closer to the bend segment and/or primary branch.

3. An antenna according to claim 1, wherein the conductive element is configured so that the secondary branch second end portion is disposed a further distance away from the signal and ground feeds than the first end portion of the secondary branch and the primary branch second end portion is disposed a further distance away from the signal and around feeds than the primary branch first end portion, and wherein the primary and secondary branch second end portions are spaced apart from each other to prevent parasitic coupling therebetween.

4. An antenna according to claim 3, wherein the primary branch defines a ¼ wave resonator at low band and a ½ wave resonator at high band operation, wherein the secondary branch defines a ¼ wave resonator at high band operation, and wherein the primary branch second end portion resides at a first corner and the secondary branch second end resids at a generally diametrically opposing corner.

5. An antenna according to claim 1, wherein the bend segment provides a current path that is substantially orthogonal to the current path in the secondary branch, and wherein current generally travels in a generally opposing direction in the first current path relative to the seconcd current path during high band operation.

6. An antenna according to claim 1, wherein, during operation, the bend segment is configured and positioned with respect to the signal and ground feeds to define a high impedance node in the current path between the bend segment and the primary branch outermost end portion, and wherein at high band, about a ¼ wave resonance is formed in the secondary branch and about a ¼ wave resonance is formed in the primary branch and a portion of the bend segment.

7. An antenna according to claim 1, wherein, in high band operation, the secondary branch and/or bend segment defines a high impedance node with a current null space in the conductive element current path so that the antenna provides about ½ wave resonance on the primary branch.

8. An antenna according to claim 1, wherein a respective one of each of the end portions of the primary and secondary branches are connected to opposing end portions of the bend segment with the remaining end portion of the primary and secondary branches being spaced apart a sufficient distance to insulate them from parasitically coupling during operation.

9. An antenna according to claim 1, wherein high band comprises frequencies that are at least equal to or greater than about twice that of the frequencies in the low band.

10. An antenna according to claim 1, wherein the bend segment is located between about 4–15 mm away from the signal feed location.

11. A planar inverted-F antenna, comprising:

a planar conductive clement having primary and secondary branches comprising:

first, second and third elongated branch segments, each having opposing first and second end portions, wherein the first, second and third elongate elements are spaced apart from each other with the second elongated segment being intermediate of the first and third elongated segments;

a first bend segment extending between the first and second elongated segments at a corresponding one of the first or second end portions thereof, and a second bend segment extending between the second and third elongated segments at the other corresponding end portion;

a signal feed electrically connected to the oonductive element proximate an outer edge portion thereof; and a ground feed electrically connected to the conductive clement proximate the signal feed at the same outer edge portion thereof, wherein the antenna is configured to operate at first and second different resonant frequency bands, wherein the conductive element has a primary current path that radiatcs as about a ¼ wave resonator during the first band of operation and about a ½ wave resonator during the second band of operation and that includes two of the first, second and third elongated segments and at least one of the bend segments, and wherein the conductive element has a secondary current path that radiates primarily during high band operation to provide about a ¼ wave resonator that includes the remaining one of the first, second or third elongated segment, wherein the primary current path is configured to radiate at the first band independent of proximity coupling to the secondary current path, and wherein the signal feed is disposed closer to the secondary current path than the ground feed and the ground feed is disposed closer to the primary current path than the signal feed.

12. An antenna according to claim 11, wherein the first band is low band and the second band is high band, and wherein the high band frequencies are at least about twice the value of the frequencies of die low frequency band.

13. An antenna according to claim 12, wherein the first, second, and third elongate branch segments have current patba that are substantially parallel and the first and second bend segments provide current paths that extend in a direction that is angularly offset from the direction of the first, second and third elongate branch segments.

14. An antenna according to claim 13, wherein the first, second and third elongate branch segments are configured to extend in a substantially vertical orientation, and the first and second bend segments arc configured to extend in a generally horizontal orientation.

15. An antenna according to claim 13, wherein the first and second bend segments are generally perpendicular to the direction of the first, second and third elongate branch segments.

16. An antenna according to claim 13, wherein the first, second and third elongate branch segments are configured to extend in a substantially horizontal orientation, and the first and second bend segments are configured to extend in a generally vertical orientation.

17. An antenna according to claim 13, wherein the first, second and third elongate branch segments and the first and second bend segments are formed from a unitary sheet of conductive material.

18. An antenna according to claim 12, wherein the primary current path segments are in conductive communication with the signal and ground feeds so as to radiate without parasitic coupling to the secondary current path in low band operation.

19. An antenna according to claim 18, wherein the conductive element is sized, configured and connected to the signal and ground feeds such that, in operation, there is a longer current path for the primary current path and a shorter current path for the secondary current path.

20. An antenna according to claim 19, and wherein the primary currant path radiates at about a ¼ wavelength at the low frequency band and at about a ½ wavelength at the high frequency band.

21. An antenna according to claim 12, wherein the signal and ground feeds are connected to an outer edge portion of the third elongated branch segment with the ground feed disposed closer to the second elongate branch segment than the signal feed and with the signal and ground feeds disposed closer to the first edge portion of the third elongated branch segment than the second edge portion, and wherein the first bend segment extends between the first and second elongated branch segments at the second end portions thereof and the second bend segment extends between the second and third elongated segments at the first end portions thereof.

22. An antenna according to claim 21, wherein the first, second and third elongated branch segments are substantially parallel with each other and the first and second bend segments are substantially perpendicular to the first, second and third elongated branch segments.

23. An antenna according to claim 22, wherein at high band operation, the secondary current path comprises the third elongated branch segment and the primary current path comprises the first bend segment and the second and third branches.

24. An antenna according to claim 23, wherein at low band operation, the conductive element radiates along the first and second bend segments and the first and second branch segments.

25. An antenna according to claim 12, wherein the signal and ground feeds are arranged about an upper edge portion of the conductive element proximate the second bend segment and first end portion of the second elongated branch segment, with The signal feed positioned closer to the third elongated branch segment and the ground feed positioned closer to the first elongated branch segment than the ground feed, wherein, in the low band of operation, the first and second elongated branch segments provide the primary current path for the signal and the third branch segment is substantially devoid of current, and wherein, in the high band of operation, the first, second, and third branch segments and the first and second bend segments radiate.

26. An antenna according to claim 25, wherein the first bend segment extends between the first and second elongated branch segments at the second end portions thereof and the second bend segment extends between the second and third elongated branch segments at the first end portions thereof.

27. An antenna according to claim 26, in combination with an elongate printed circuit board, wherein the first, second and third elongated branch segments are oriented to be substantially parallel to the lateral direction of the elongate printed circuit board.

28. An antenna according to claim 26, wherein the second branch segment is disposed intermediate of the first and third elongated branch segments with elongate gaps of air Md/or dielectric material positioned between the first and second elongated branch segments and second and third elongated branch segments.

29. An antenna according to claim 26, wherein the first elongated branch segment is a left branch, the second elongated branch segment is the intermediate branch and the third elongated branch segment is the right branch, and wherein the first, second and third elongated branch segments are generally parallel to each other.

30. An antenna according to claim 29, in combination with an elongate printed circuit board, wherein the first, second and third elongated branch segments ire oriented to be substantially parallel to the longitudinal direction of the elongate printed circuit board.

31. An antenna according to claim 12, wherein the signal and ground feeds are configured to connect proximate an outer edge portion of the first elongated branch segment with the ground feed disposed closer to the second elongated branch segment than the signal feed, and wherein the first bend segment extends between the first end portions of the first and second elongated branch segments and the second bend segment extends between the second end portions of the second and third elongated branch segments.

32. An antenna according to claim 31, wherein the first, second and third elongated branch segments are generally parallel to each other.

33. An antenna according to claim 32, wherein in operative position in a housing, the first, second and third elongated branch segments are oriented to be substantially parallel to the lateral direction of an elongate printed circuit board.

34. An antenna according to claim 31, wherein, in operative position in a housing, the first, second and third elongated branch segments are oriented to be substantially parallel to the longitudinal direction of an elongate printed circuit board.

35. An antenna according to claim 31, wherein the first elongated branch segment is the right-most or left-most elongated branch segment and the third elongated branch segment is the corresponding other of the left-most or right-most elongated branch segment, respectively.

36. An antenna according to claim 35, wherein the second and third elongated branch segments radiate in both low and high band operation while the first elongated branch segment radiates in the high band but is substantially devoid of radiation in the low band of operation.

37. An antenna according to claim 36, wherein the first, second and third elongated branch segments and first and second bend segments provide about a ½ wave resonance in high band operation.

38. An antenna according to claim 31, wherein the first bend segment angles downwardly from the first elongated branch first end portion toward the second elongated branch first end portion.

39. An antenna according to claim 31, wherein the third elongated branch segment first end portion includes a generally co-planar extension that is configured to turn toward the first elongated branch segment and is sized and configured to capacitively couple to the first elongated branch segment first end portion and/or first bend segment during operation.

40. An antenna according to claim 12, wherein the signal and ground feeds are arranged about the second intermediate elongated branch segment of the conductive element, with the signal feed positioned closer to the first elongated branch segment and the ground feed positioned closer to the third elongated branch segment, wherein the conductive element comprises a fourth elongated branch segment, and wherein in low band operation, the first, second, and fourth elongated branch segments provide the primary current path for the signal, wherein, in high band operation, the first, third and fourth elongated branch segments radiate and wherein, the third segment radiates to a greater degree in high band than in low band.

41. An antenna according to claim 40, wherein the first bend segment extends between the first and second elongated branch segments at the second end portions thereof and the second bend segment extends between the second and third elongated branch segments at the first end portions thereof.

42. An antenna according to claim 40, wherein the fourth elongated branch segment is the right most branch, wherein the first elongated branch segment is the left most elongated branch segment, and the second elongated branch segment is the right intermediate elongated branch segment, and the third elongated branch segment is a left-intermediate elongated branch segment that is disposed closer to the fourth elongated branch segment or the branch segments are formed in a minor image thereof, and wherein the first, second, third, and fourth elongated branch segments are generally parallel to each other.

43. An antenna according to claim 42, wherein, in operative position, the first, second, third and fourth elongated branch segments are oriented to be substantially parallel to the longitudinal direction of an elongate printed circuit board.

44. An antenna according to claim 42, wherein the first elongated branch segment first end portion comprises a generally co-planar extension that turns in toward the intermediate second elongated branch segment and then turns down toward the first bend segment.

45. An antenna according to claim 11, wherein the conductive element first and/or second bend segments are configured with a high impedance node to generate at least one current null space in a current path during one of the first or second bands of operation.

46. An antenna according to claim 11, wherein the conductive element arranges the segments serially from the first elongate branch segment to the first bend segment to the second elongate branch segment to the second bend segment to the third elongate branch segment, wherein the segments are in conductive communication with the signal and ground feed.

47. A wireless terminal, comprising:

(a) a housing configured to enclose a transceiver that transmits and receives wireless communications signals;

(b) a ground plane disposed within the housing;

(c) a planar inverted-F antenna disposed within the housing and electrically connected with the transceiver, wherein the antenna comprises:

a planar dielectric substrate;

a planar conductive element disposed on the planar dielectric substrate, comprising:

a primary branch having a length and opposing first and second end portions, the primary branch being configured to define about a ¼ wave resonator at a low frcquency band;

a bend segment having opposing first and second end portions, the first end portion terminating into the second end portion of the primary branch;

a secondary branch connected to the second end portion of the bend segment wherein the secondary branch defines a ¼ wave resonator at the high frequency band and has substantially reduced current flow at the low frequency band relative to the high frequency band, wherein the secondary and primary branches both radiate at the high frequency band to provide about a ½ wave resonance;

(d) a signal feed electrically connected to the secondary branch or bend segment of the primary branch of The conductive element prociniate a first portion thereof; and (e) a ground feed electrically connected to the conductive element proximate the signal feed about the first portion of the conductive element, wherein the ground and signal feeds are positioned adjacent each other proximate a common edge portion of the conductive element.

48. A wireless terminal according to claim 47, wherein the primary branch second end portion is spaced apart a sufficient distance from the secondary branch so that the primary branch radiates in low band independent of proximity coupling to the secondary branch, and wherein the bend segment is configured and positioned with respect to the signal and ground and the secondary branch so that, in low band operation, current flows into the primary branch but the secondary branch has current flow that is substantially reduced from that in high band operation and so that, in high band operation, current flows in at least a major portion of both the primary and secondary branches.

49. A wireless terminal according to claim 47, wherein the conductivc element is configured to define a current null proximate the bend region during high band operation, and wherein the ground and signal feeds are positioned adjacent each other on a common outer edge portion of the conductive element proximate the bend segment and/or first end portion of the secondary branch, with the signal feed being disposed closer to the secondary branch and the pound feed being disposed closer to the bend segment and/or primary branch.

50. A wireless terminal according to claim 49, wherein the conductive element is configured so that the secondary branch second end portion is disposed a further distance away from the signal and ground feeds than the rst end portion of the secondary branch and the primary branch second end portion is disposed a further distance away from the signal and ground feeds than the primary branch first end portion, and wherein the primary and secondary branch second end portions are spaced apart from each other a distance sufficient to prevent parasitic coupling therebetween.

51. A wireless terminal according to claim 47, wherein the high frequency band has frequencies that are equal to or greater than about twice the frequencies of the low band, and wherein the ground and signal feeds are positioned adjacent each other on a common outer edge portion of the conductive element proximate the bend segment and/or first end portion of the secondary branch, with the signal feed being disposed closer to the secondary branch and the ground feed being disposed closer to the bend segment and/or primary branch.

52. A wireless terminal according to claim 47, wherein the low frequency band comprises at least one of 824–894 MHz and/or 880–960 MHz, and wherein the high frequency band comprises frequencies that are at least twice the value of the frequencies in the low band.

53. A wireless terminal according to claim 47, wherein the signal and ground feeds are disposed proximate a common outer edge portion of the conductive element, wherein the bend segment in the primary branch is configured to reside at about 4–15 mm from the signal feed location, and wherein the conductive element has dimensions which reside within an area of about 1200 $mm^2$.

54. A wireless terminal according to claim 47, wherein the low frequency band comprises at least one of 850 MHz and/or 900 MHz and the high frequency band comprises at least one of 1800 MHz and/or 1900 MHz.

55. A wireless terminal according to claim 47, wherein the bend segment provides a current path tbat is substantially orthogonal to a current path in the secondary branch, and wherein current generally travels a different direction in the primary branch current path than in the secondary branch current path during high band operation.

56. A wireless terminal according to claim 47, wherein, during operation, the bend segment is configured and positioned with respect to the signal and ground feeds to define a high impedance node with a current null in a current path between the bend segment and the primary branch outermost second end portion, and wherein at high band, about a ¼ wave resonance is formed in the secondary branch and about a ½ wave resonance is formed in the primary branch and a portion of the bend segment.

57. A wireless terminal according to claim 47, wherein the primary branch first end portion resides at a first corner and the secondary branch first end portion resides at a generally diametrically opposing corner of the conductive element.

58. A method for exciting a planar inverted F antenna having low and high band operational modes:

providing a conductive element with primary and secondary resonant branches, the conductive element configured so that the secondary branch terminates into a bend region before extending into the primary branch, the primary branch being configured to form about a ¼ wave resonator at a low frequency band, the secondary branch configured to act as about a ¼ wave resonant at a high frequency band;

generating a high impedance node to provide a current null proximate the secondary branch and/or the bend region of the primary branch during operation in the high frequency band;

coupling the conductive element to signal and ground feeds that are positioned adjacent each other proximate a common edge portion of the conductive element; and causing the primary branch with the secondary branch resonance to provide about a ½ wave resonator during operation in the high frequency band.

59. A method according to claim 58, further comprising configuring the primary and secondary branches so that the primary branch radiates independent of proximity coupling to the secondary branch and prevents parasitic coupling between the primary and secondary branches.

60. A method according to claim 58, wherein the coupling the conductive element to signal and ground feeds comprises coupling signal and ground feeds that are positioned adjacent each other proximate a common outer edge portion of the conductive element proximate the bend segment and/or first end of the secondary branch, with the signal feed being disposed closer to the secondary branch and the ground feed being disposed closer to the bend segment and/or primary branch.

61. A method according to claim 60, wherein the high band has frequencies that are at least about twice the value of the frequencies of the low band.

62. A method according to claim 61, wherein the high impedance node is positioned at between about 4–15 mm away from the signal feed.

63. A method according to claim 60, wherein current generally travels a generally opposing direction in a first current path defined by the primary branch than in a second current path defined by the secondary branch during high band operation.

64. A method according to claim 58, wherein the primary branch operates as about a ½ wave resonator at the high frequency band, and wherein the high frequency band has frequencies that are equal to or greater than about twice the frequencies of the low band, and wherein the second end portion of the primary branch resides at a first corner of the conductive element and the second end portion of the secondary branch resides at a generally diametrically opposing corner of the conductive element.

* * * * *

UNITED STATES PATENT AND TRADEMARK OFFICE

CERTIFICATE OF CORRECTION

PATENT NO. : 6,903,686 B2
DATED : June 7, 2005
INVENTOR(S) : Vance et al.

It is certified that error appears in the above-identified patent and that said Letters Patent is hereby corrected as shown below:

Column 15,
Line 12, should read -- wherein the ground and signal feeds are positioned adja- --.
Line 16, should read -- and ground and the secondary branch so that, in low --.
Line 35, should read -- ground feeds than the primary branch first end portion, and --.
Line 44, should read -- at a first corner and the secondary branch second end resides --.

Column 16,
Line 52, should read -- the value of the frequencies of the low frequency band. --.
Line 55, should read -- paths that are substantially parallel and the first and second --.

Column 17,
Line 53, should read -- segment, with the signal feed positioned closer to the third --.

Column 18,
Line 8, should read -- elongated branch segments with elongate gaps of air and/or --.
Line 19, should read -- second and third elongated branch segments are oriented to --.

Column 20,
Lines 14-15, should read -- branch or bend segment of the primary branch of the conductive element proximate a first portion thereof; --.
Line 42, should read -- disposed closer to the secondary branch and the ground feed --.
Line 48, should read -- away from the signal and ground feeds than the first end --.

Signed and Sealed this

Tenth Day of January, 2006

JON W. DUDAS
*Director of the United States Patent and Trademark Office*